US009483008B2

(12) United States Patent
Ye et al.

(10) Patent No.: US 9,483,008 B2
(45) Date of Patent: Nov. 1, 2016

(54) IMAGE FORMING APPARATUS

(71) Applicant: Konica Minolta, Inc., Chiyoda-ku, Tokyo (JP)

(72) Inventors: Chao Ye, Toyokawa (JP); Naoto Sugaya, Toyokawa (JP); Munehiro Natsume, Toyokawa (JP); Nobuhiro Matsuo, Toyokawa (JP); Seiichi Kirikubo, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/964,396

(22) Filed: Dec. 9, 2015

(65) Prior Publication Data

US 2016/0170362 A1 Jun. 16, 2016

(30) Foreign Application Priority Data

Dec. 16, 2014 (JP) ..... 2014-253597
Nov. 30, 2015 (JP) ..... 2015-233004

(51) Int. Cl.

| | |
|---|---|
| ***B65H 5/00*** | (2006.01) |
| ***G03G 15/00*** | (2006.01) |
| ***B65H 3/06*** | (2006.01) |
| ***B65H 5/06*** | (2006.01) |

(52) U.S. Cl.

CPC ..... *G03G 15/6529* (2013.01); *B65H 3/0669* (2013.01); *B65H 5/06* (2013.01); *B65H 2403/70* (2013.01); *B65H 2403/72* (2013.01); *B65H 2515/702* (2013.01)

(58) Field of Classification Search

CPC ..... B65H 3/0669; B65H 2403/70; B65H 2403/72; B65H 2515/702

See application file for complete search history.

(56) References Cited

U.S. PATENT DOCUMENTS

| | | | | |
|---|---|---|---|---|
| 6,519,443 | B1 * | 2/2003 | Coriale | B65H 5/34 399/388 |
| 7,396,009 | B2 * | 7/2008 | Elliott | B65H 5/34 271/10.03 |
| 2013/0049297 | A1 * | 2/2013 | Herrmann | G03G 15/6576 271/272 |

FOREIGN PATENT DOCUMENTS

| | | | |
|---|---|---|---|
| JP | 2002370845 | A | 12/2002 |
| JP | 2009161926 | A | 7/2009 |
| JP | 2012140212 | A | 7/2012 |
| JP | 2013151340 | A | 8/2013 |

* cited by examiner

*Primary Examiner* — Howard Sanders
(74) *Attorney, Agent, or Firm* — Holtz, Holtz & Volek PC

(57) ABSTRACT

An image forming apparatus includes an induced voltage detection portion configured to detect an induced voltage Vk in a motor; and an engagement/disengagement completion time detection portion configured to detect an engagement completion time and a disengagement completion time based on the induced voltage Vk detected by the induced voltage detection portion. The engagement completion time is a time at which engagement of a clutch is actually completed. The disengagement completion time is a time at which disengagement of the clutch is actually completed. A control portion determines a command timing based on any one of the engagement completion time and the disengagement completion time detected by the engagement/disengagement completion time detection portion, the command timing being a time at which a command is given to the clutch to perform an engaging operation or a disengaging operation.

12 Claims, 23 Drawing Sheets

IMAGE FORMING APPARATUS

This application is based on Japanese patent application No. 2014-253597 filed on Dec. 16, 2014 and Japanese patent application No. 2015-233004 filed on Nov. 30, 2015, the contents of which are hereby incorporated by reference.

BACKGROUND OF THE INVENTION

1. Field of the Invention

The present invention relates to an image forming apparatus for forming an image onto paper.

2. Description of the Related Art

In an image forming apparatus such as a printer, a copier, or a multi-function device, paper supplied from a paper containing portion is conveyed. The image forming apparatus performs printing, at a predetermined position, onto the paper which is being conveyed. The image forming apparatus has an internal paper path on which rollers are provided at intervals each of which is shorter than the length of paper in the longitudinal direction. The image forming apparatus controls the rotary drive of the rollers to allow the paper to pass through the positions on the paper path at an appropriate time.

In order to start/stop the rotary drive of the rollers, a clutch is often used. The clutch is provided between the rollers and a motor operating as the drive source of the rollers to connect/disconnect transmission of the rotational driving force. This enables the rollers to stop with the motor remains rotating. The clutch is used, for example, for the case where one motor is used in common as the drive source of rollers which rotate at different times.

The clutch has a delay in its response to control signals. To be specific, one example of the delay is an engagement delay in response to a command to switch from a disengagement state where the rollers and the motor are disengaged from one another to an engagement state where the rollers and the motor are engaged with one another. Another example of the delay is a disengagement delay in response to a command to switch from the engagement state to the disengagement state. The engagement delay and the disengagement delay vary according to the individual differences of clutches. Further, a difference in thickness of paper makes a difference in torque applied to the rollers (load from the motor side), leading to variations in the engagement delay and the disengagement delay.

In relation to control of a clutch in an image forming apparatus, a sheet conveyance device has been proposed. In the sheet conveyance device, data on stop characteristics of rollers with clutches disengaged are stored, and engaging timing of the clutches is controlled based on the data stored (Japanese Unexamined Patent Application Publication No. 2002-370845).

Another technology has been proposed in which an engagement time (engagement delay) from a time point at which clutches are engaged to a time point at which variations in rotational speed of the motor falls within a predetermined range is measured, and a time at which an engagement command is given to the clutches after the clutches are disengaged is determined based on the engagement time (Japanese Unexamined Patent Application Publication No. 2012-140212).

In a print job of conveying sheets of paper continuously, it is desirable to minimize a gap between sheets of paper (inter-sheet space) to improve the productivity of printing.

According to the technology disclosed in Japanese Unexamined Patent Application Publication No. 2002-370845, the sheet conveyance is controlled based on the data, stored in advance, related to response delay. Therefore, it is difficult to deal with variations in response delay due to mechanical differences in image forming apparatuses, variations in load, change in environment, aging, and so on. Stated differently, since the response delay is not actually measured, it is necessary to expect variations in a certain length of response delay. It is also necessary to control the clutches at a time when margins are provided to avoid having an excessively small inter-sheet space even if the response delay is largest within the expected range of delay. Unfortunately, this makes it impossible to minimize the inter-sheet space.

In contrast, according to the technology described in Japanese Unexamined Patent Application Publication No. 2012-140212, the response delay is actually measured based on the rotational speed of the motor. Therefore, minimizing an inter-sheet space is possible in principle.

A technique for detecting a change in rotational speed of a motor is applicable only to a motor having rotational speed varying in accordance with torque, e.g., a brushless DC Motor. Unfortunately, the technique is not applicable to other types of motors. Therefore, in using a synchronous motor having no variations in rotational speed, e.g., a stepper motor, for paper conveyance, minimizing an inter-sheet space is unfortunately impossible.

SUMMARY

The present disclosure has been achieved in light of such an issue, and therefore, an object of an embodiment of the present invention is to improve the productivity of printing by an image forming apparatus which uses a synchronous motor and a clutch to convey sheets of paper.

An image forming apparatus according to an aspect of the present invention is an image forming apparatus which has a roller for conveying paper, a synchronous motor for rotationally driving the roller, a clutch for transmitting a rotational driving force of the motor to the roller, and a control portion, and forms an image onto the paper conveyed by the roller. The image forming apparatus includes an induced voltage detection portion configured to detect an induced voltage Vk in the motor; and an engagement/disengagement completion time detection portion configured to detect an engagement completion time and a disengagement completion time based on the induced voltage Vk detected by the induced voltage detection portion, the engagement completion time being a time at which engagement of the clutch is actually completed, the disengagement completion time being a time at which disengagement of the clutch is actually completed; wherein the control portion determines a command timing based on any one of the engagement completion time and the disengagement completion time detected by the engagement/disengagement completion time detection portion, the command timing being a time at which a command is given to the clutch to perform an engaging operation or a disengaging operation.

These and other characteristics and objects of the present invention will become more apparent by the following descriptions of preferred embodiments with reference to drawings.

DESCRIPTION OF THE PREFERRED EMBODIMENTS

Figure 1:
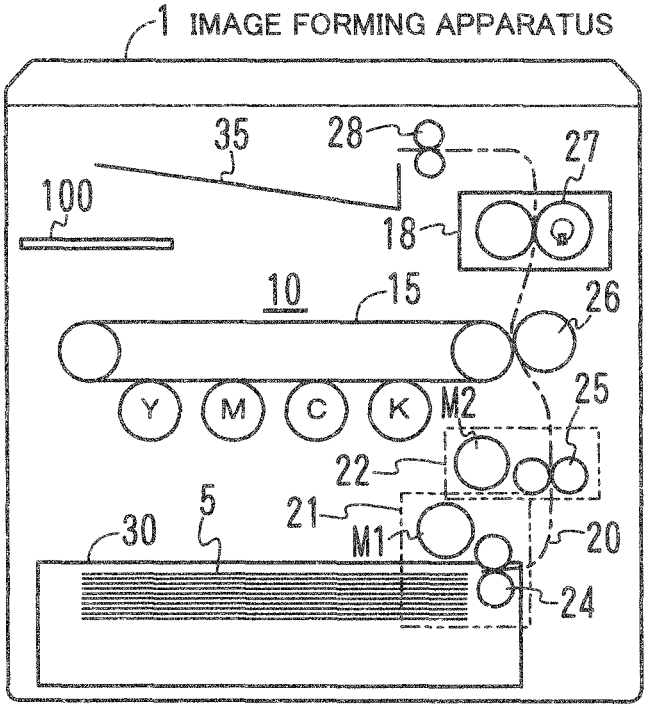
FIG. 1 is a schematic diagram showing an example of the structure of the main part related to paper conveyance in an image forming apparatus according to an embodiment of the present invention.

FIG. 1 is a schematic diagram showing an example of the structure of the main part for conveying paper 5 in an image forming apparatus 1 according to an embodiment of the present invention. The image forming apparatus 1 is a color printer which is provided with a tandem image forming portion 10 for forming an image by electrophotography. The image forming apparatus 1 is not limited thereto. The image forming apparatus 1 may be a monochrome printer, a copier, a multifunctional peripheral, or a facsimile machine.

The image forming apparatus 1 forms an image onto the paper 5 conveyed, along a paper path 20, by rotary drive of rollers, and ejects the paper 5. The image forming apparatus 1 includes paper feed rollers 24, timing rollers 25, secondary transfer rollers 26, fixing rollers 27, and discharge rollers 28.

The paper feed rollers 24 are to transport, to the paper path 20, sheets of paper 5, one by one, loaded in a paper cassette 30 as a paper containing portion. In the following description, the operation that the paper feed rollers 24 transport the paper 5 is sometimes referred to as "paper feed". Further, the operation that pickup rollers (not shown), for example, put the paper 5 from the upstream into a nip of the paper feed rollers 24 which does not operate before the paper feed is sometimes referred to as "paper feed preparation".

The paper feed rollers 24 are rotationally driven by a synchronous motor M1. In this embodiment, the motor M1 is a stepper motor. However, the motor M1 is not limited thereto and may be another type of the motor. The motor M1 is provided in the image forming apparatus 1 to operate as the drive source of a first roller drive mechanism 21.

The timing rollers 25 are to deliver the paper 5 sent by the paper feed rollers 24 to a transfer position along the paper path 20. The transfer position is a position at which the image is transferred onto the paper 5 with a transfer belt 15 of the image forming portion 10 and the secondary transfer roller 26 facing each other. The timing rollers 25 temporarily halt the sent paper 5 in the upstream of the transfer position. The timing rollers 25 then resume the conveyance of the paper 5 at a predetermined time to adjust the position for transfer of a toner image from the transfer belt 15 onto the paper 5. The timing rollers 25 then send the paper 5 to the transfer position.

The timing rollers 25 are rotationally driven by a synchronous motor M2. In this embodiment, the motor M2 is a stepper motor. However, the motor M2 is not limited thereto and may be another type of the motor. The motor M2 is provided in the image forming apparatus 1 to operate as the drive source of a second roller drive mechanism 22. In this example, the motor M2 has a structure similar to that of the motor M1. The motor M2, however, may have a structure different from that of the motor M1.

The secondary transfer rollers 26 are to transfer the toner image from the transfer belt 15 onto the paper 5. The fixing rollers 27 are provided in a fixing unit 18 to apply heat and pressure to the paper 5 to which the toner image has been transferred. The discharge rollers 28 are to output, to a paper exit tray 35, the paper 5 which has passed through the fixing unit 18 and has the image formed thereon.

Figure 2A:
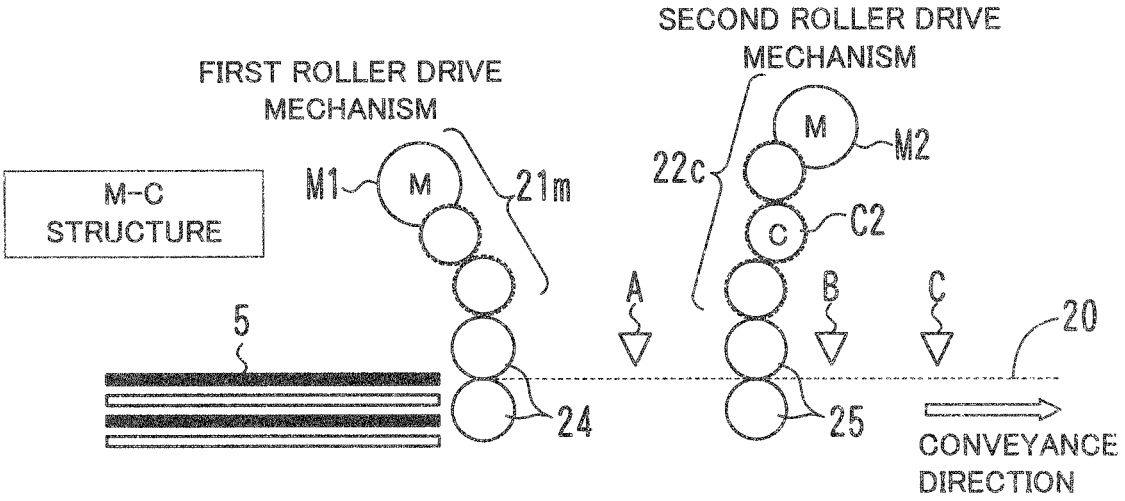
FIG. 2A shows an example of an M-C structure related to a roller drive mechanism for conveying sheets of paper.
Figure 2B:
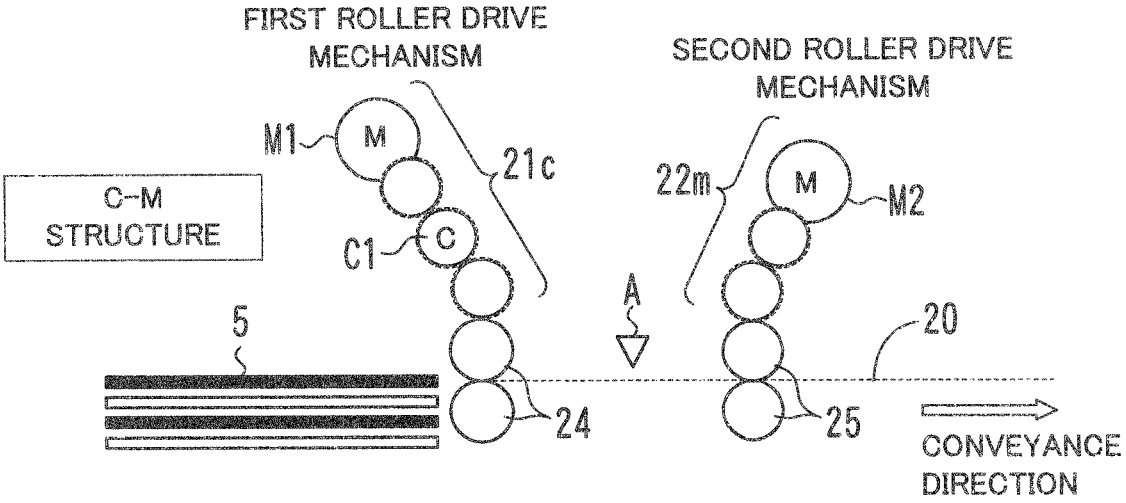
FIG. 2B shows an example of a C-M structure related thereto.
Figure 2C:
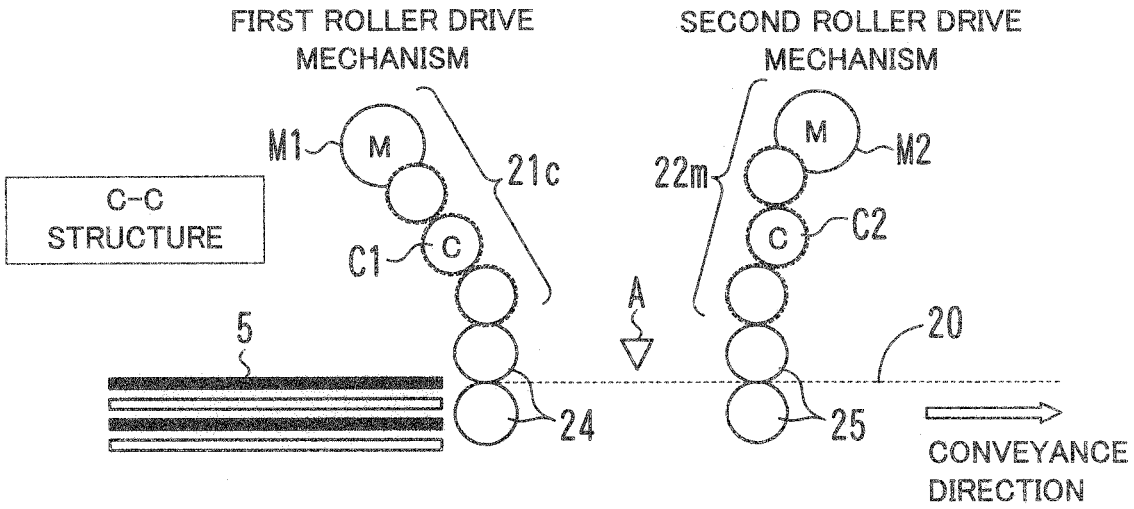
FIG. 2C shows an example of a C-C structure related thereto.

FIG. 2A shows an example of an M-C structure related to the first and second roller drive mechanisms 21 and 22; FIG. 2B shows an example of a C-M structure related thereto; and FIG. 2C shows an example of a C-C structure related thereto.

In the process of manufacturing the image forming apparatus 1, the structure of the first roller drive mechanism 21 is selectable. To be specific, the first roller drive mechanism 21 may have a structure in which a clutch is interposed between the motor M1 and the paper feed rollers 24. Alternatively, the first roller drive mechanism 21 may have a structure in which no clutch is interposed therebetween. Similarly, the structure of the second roller drive mechanism 22 is also selectable. To be specific, the second roller drive mechanism 22 may have a structure in which a clutch is interposed between the motor M2 and the timing rollers 25. Alternatively, the second roller drive mechanism 22 may have a structure in which no clutch is interposed therebetween.

Thus, in the case of using at least one clutch, there are three types of combinations of the structures of the first and second roller drive mechanisms 21 and 22. The three types of combinations are as follows.

FIG. 2A shows the structure referred to as "M-C structure". The M-C structure is a combination of a first roller drive mechanism 21*m* having no clutch and a second roller drive mechanism 22*c* having a clutch.

The first roller drive mechanism 21*m* includes the motor M1 and at least one gear for transmitting the rotational driving force of the motor M1 to the paper feed rollers 24. With the first roller drive mechanism 21*m*, the paper feed rollers 24 are engaged with the motor M1 without a clutch.

The second roller drive mechanism 22*c* includes the motor M2, at least one gear for transmitting the rotational driving force of the motor M2 to the timing rollers 25, and a timing clutch C2 for continuing/intermitting the transmission of the rotational driving force. With the second roller drive mechanism 22*c*, the timing rollers 25 are engaged with the motor M2 through the timing clutch C2.

The use of the M-C structure enables the motor M2 to be used not only to drive the timing rollers 25 but to drive, for example, the secondary transfer rollers 26. The motor M2 is shared for rotary drive of the rollers at different times. This reduces the number of motors mounted on the image forming apparatus 1, leading to the reduction in cost of components.

FIG. 2B shows the structure referred to as "C-M structure". The C-M structure is a combination of a first roller drive mechanism 21*c* having a clutch and a second roller drive mechanism 22*m* having no clutch.

The first roller drive mechanism 21*c* includes the motor M1, at least one gear for transmitting the rotational driving force of the motor M1 to the paper feed rollers 24, and a paper feed clutch C1 for continuing/intermitting the transmission of the rotational driving force. With the first roller drive mechanism 21*c*, the paper feed rollers 24 are engaged with the motor M1 through the paper feed clutch C1.

The second roller drive mechanism 22*m* includes the motor M2 and at least one gear for transmitting the rotational driving force of the motor M2 to the timing rollers 25. With the second roller drive mechanism 22*m*, the timing rollers 25 are engaged with the motor M2 without a clutch.

The use of the C-M structure enables the motor M1 to be used not only to drive the paper feed rollers 24 but to drive, for example, paper feed rollers provided in another paper supply inlet. Suppose that, for example, the image forming apparatus 1 is provided with the paper feed rollers 24 and other paper feed rollers because the paper cassette 30 has a multi-stage structure or a manual paper feed tray is provided. In such a case, it is possible to share the motor M1 by rotating the motor M1 normally to drive one of the rollers and rotating the motor M1 reversely to drive the other roller.

FIG. 2C shows the structure referred to as "C-C structure". The C-C structure is a combination of the first roller drive mechanism 21*c* having the paper feed clutch C1 and the second roller drive mechanism 22*m* having the timing clutch C2. The use of the C-C structure enables each of the motor M1 and the motor M2 to be shared for rotary drive of the rollers at different times.

Figure 3:
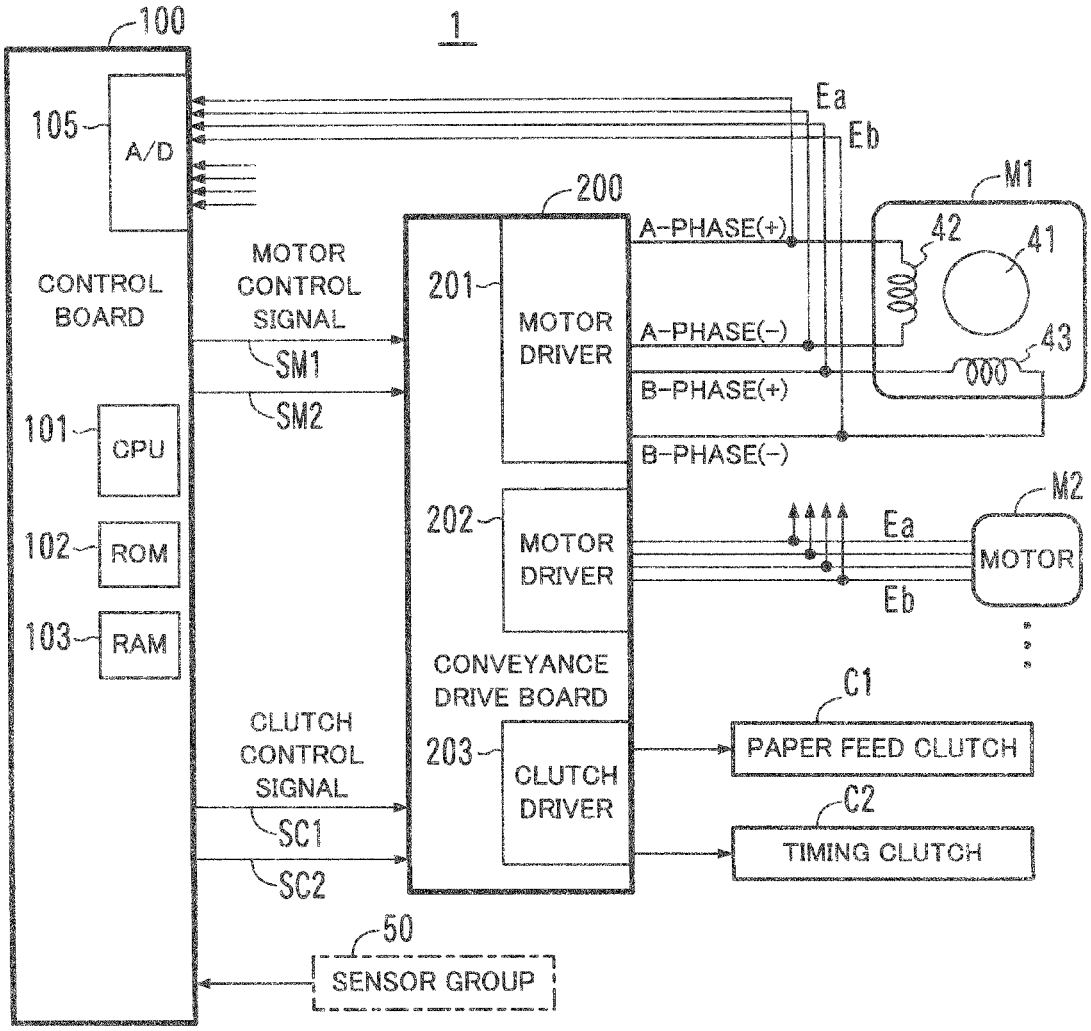
FIG. 3 is a block diagram showing an example of the hardware configuration of a control system of an image forming apparatus.

FIG. 3 shows an example of the hardware configuration of a control system of the image forming apparatus 1. The image forming apparatus 1 includes a control board 100 and a conveyance drive board 200.

The control board 100 includes a Central Processing Unit (CPU) 101, a Read Only Memory (ROM) 102, a Random Access Memory (RAM) 103, an A/D converter 105, an interface component, and other peripheral components.

The CPU 101 is an example of a control portion of the image forming apparatus 1. The CPU 101 executes a program stored in the ROM 102 to control the entire operation of the image forming apparatus 1, e.g., operation of conveying the paper 5. The CPU 101 uses the RAM 103 as a work area for program execution.

The conveyance drive board 200 includes motor drivers 201 and 202 for driving the motors M1 and M2, respectively.

The motor driver 201 applies an AC voltage changing periodically to an A-phase coil 42 and a B-phase coil 43 of the motor M1 to rotate a rotor 41 of the motor M1. The AC voltage is normally a voltage having a rectangular waveform. The rectangular waveform is obtained by periodically turning ON/OFF the output voltage of a constant voltage source. Alternatively, the rectangular waveform is obtained by periodically inversing the polarity of the output voltage. The rectangular waveform may also be synthesized with an appropriate switching circuit by using a pulse train or a pulse-width modulation (PWM) signal having a frequency higher than that of the rectangular waveform. The use of the pulse train or PWM enables current control on the motor M1.

The motor driver 201 rotates or stops the motor M1 in response to a motor control signal SM1 fed from the control board 100.

A voltage across both ends of the A-phase coil 42, namely, a coil voltage Ea, is fed to the A/D converter 105 of the control board 100 as a signal for detecting an induced voltage developed during rotation of the motor M1. Instead of this, a coil voltage Eb across both ends of the B-phase coil 43 may be used as the signal for detecting an induced voltage.

As with the case of the motor driver 201, the motor driver 202 applies an AC voltage changing periodically to the motor M2 to rotate the motor M2. In short, the motor driver 202 rotates or stops the motor M2 in response to a motor control signal SM2 as with the case of the motor driver 201.

The coil voltage Ea of an A-phase coil of the motor M2 is fed to the A/D converter 105 as a signal for detecting an induced voltage of the motor M2. Instead of this, a coil voltage Eb of a B-phase coil may be used as the signal for detecting an induced voltage.

With the C-C structure used, the paper feed clutch C1 and the timing clutch C2 are connected to the conveyance control board 200 as shown in FIG. 3, and a clutch driver 203 is mounted on the conveyance control board 200 to drive the paper feed clutch C1 and the timing clutch C2. The clutch driver 203 turns ON/OFF the paper feed clutch C1 (engagement/disengagement) in response to a clutch control signal SC1 fed from the control board 100. The clutch driver 203 also turns ON/OFF the timing clutch C2 in response to a clutch control signal SC2 fed from the control board 100.

With the M-C structure used, it is not necessary to connect the paper feed clutch C1 to the conveyance control board 200. With the C-M structure used, it is not necessary to connect the timing clutch C2 to the conveyance control board 200.

Figure 4:
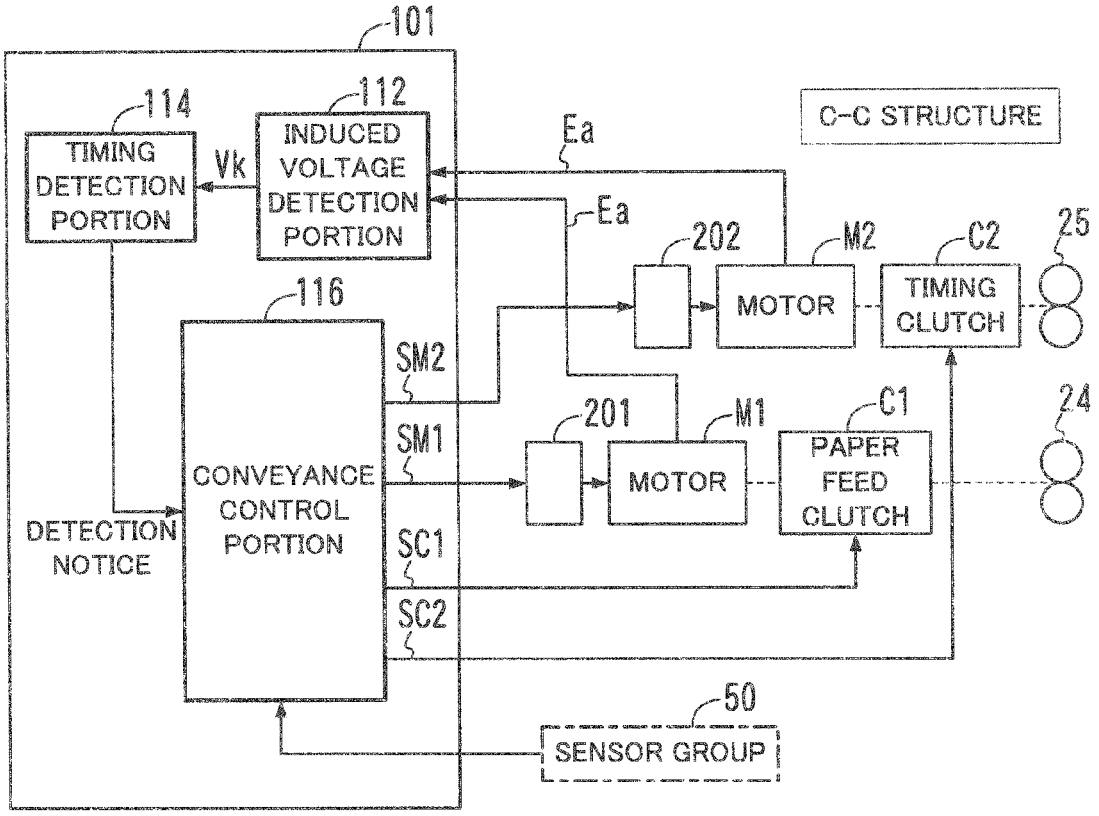
FIG. 4 is a block diagram showing an example of the functional configuration of a CPU of a control system.

FIG. 4 shows an example of the functional configuration of the CPU 101 of the control system. FIG. 4 takes an example of the C-C structure. Description is provided in which the image forming apparatus 1 includes both the paper feed clutch C1 and the timing clutch C2.

The CPU 101 includes structural elements for control of paper conveyance. The structural elements are, for example, an induced voltage detection portion 112, a timing detection portion 114, and a conveyance control portion 116. The structural elements are functional elements implemented by executing the programs by the CPU 101.

The induced voltage detection portion 112 serves to detect an induced voltage Vk in each of the motors M1 and M2.

The induced voltage detection portion 112 is an example of the "induced voltage detection portion" recited in the present invention. The induced voltage detection portion 112 monitors, for example, the coil voltage Ea of the A-phase coil 42 in each of the motors M1 and M2. The induced voltage detection portion 112 then detects, as the induced voltage Vk, the coil voltage Ea of the A-phase coil 42 for the case where a current flowing through the A-phase coil 42 is 0 (zero). The detection method is described later.

The timing detection portion 114 serves to detect an engagement completion time and a disengagement completion time based on the induced voltage Vk detected by the induced voltage detection portion 112. The engagement completion time is a time at which engagement of each of the paper feed clutch C1 and the timing clutch C2 is actually completed. The disengagement completion time is a time at which disengagement of each of the paper feed clutch C1 and the timing clutch C2 is actually completed. The timing detection portion 114 is an example of the "engagement/disengagement completion time detection portion" recited in the present invention. When detecting the engagement completion time or the disengagement completion time, the timing detection portion 114 informs the conveyance control portion 116 of the fact.

The timing detection portion 114 detects, as the engagement completion time, a time at which the induced voltage Vk becomes smaller than a first threshold Va. The first threshold Va is determined based on the magnitude of an induced voltage for the case where a load placed on the motor M1 or the motor M2 is a minimum load with the paper feed clutch C1 or the timing clutch C2 engaged.

The timing detection portion 114 also detects, as the disengagement completion time, a time at which the induced voltage Vk becomes greater than a second threshold Vb. The second threshold Vb is determined based on the magnitude of an induced voltage for the case where a load placed on the motor M1 or the motor M2 is a maximum load with the paper feed clutch C1 or the timing clutch C2 engaged.

The first threshold Va or the second threshold Vb may be changed depending on the rotational speed of the motor M1 or the motor M2.

The conveyance control portion 116 controls the conveyance of the paper 5 from paper feed to paper discharge performed by the rollers including the paper feed rollers 24 and the timing rollers 25. The conveyance control portion 116 is an example of the "control portion" recited in the present invention. The conveyance control portion 116 finds the position of the paper 5 based on an output of the timing detection portion 114 and an output of a paper sensor of a group of sensors 50, and rotates or stops the individual rollers appropriately. The conveyance control portion 116 outputs the motor control signals SM1 and SM2 to the motor drivers 201 and 202, respectively. The conveyance control portion 116 outputs the clutch control signals SC1 and SC2 to the paper feed clutch C1 and the timing clutch C2, respectively.

For a print job involving the use of a plurality of sheets of paper 5, the conveyance control portion 116 determines a command timing at which a command is given to the paper feed clutch C1 or the timing clutch C2 to perform an engaging operation or a disengaging operation. The determination is made based on the engagement completion time or the disengagement completion time detected by the timing detection portion 114. In making the determination, the conveyance control portion 116 performs control in such a manner that a gap between two sheets of paper 5 conveyed continuously by the paper feed rollers 24 and the timing rollers 25, namely, an inter-sheet space, has a value falling within a predetermined range.

To be specific, with the M-C structure used, when the paper feed rollers 24 and the timing rollers 25 convey the n-th sheet of paper 5 ("n" is an integer) and temporarily stop conveying the n-th sheet of paper 5, and then, the timing rollers 25 starts reconveying the n-th sheet of paper 5 and the paper feed rollers 24 start transporting the (n+1)-th sheet of paper 5, the conveyance control portion 116 determines a time to give a rotary drive command to the motor M1 in accordance with a stop position of the n-th sheet of paper 5 determined based on a period of time (T1) from a rotary drive start time of the motor M1 to the disengagement completion time of the timing clutch C2 in such a manner that the (n+1)-th sheet of paper 5 does not overlap the n-th sheet of paper 5.

With the C-M structure used, when the paper feed rollers 24 and the timing rollers 25 convey the n-th sheet of paper 5 and temporarily stop conveying the n-th sheet of paper 5, and then, the timing rollers 25 start reconveying the n-th sheet of paper 5 and the paper feed rollers 24 start transporting the (n+1)-th sheet of paper 5, the conveyance control portion 116 determines a time to give an engagement operation command to the paper feed clutch C1 in accordance with a stop position of the n-th sheet of paper 5 determined based on a period of time (T2) from the disengagement completion time of the paper feed clutch C1 to a rotary drive stop time of the motor M2 in such a manner that the (n+1)-th sheet of paper 5 does not overlap the n-th sheet of paper 5.

With the C-C structure used, when the paper feed rollers 24 and the timing rollers 25 convey the n-th sheet of paper 5 and temporarily stop conveying the n-th sheet of paper 5, and then, the timing rollers 25 start reconveying the n-th sheet of paper 5 and the paper feed rollers 24 start transporting the (n+1)-th sheet of paper 5, the conveyance control portion 116 determines a time to give an engagement operation command to the paper feed clutch C1 in accordance with the stop position of the n-th sheet of paper 5 determined based on a period of time (T3) from the engagement completion time of the paper feed clutch C1 to a disengagement completion time of the timing clutch C2 in such a manner that the (n+1)-th sheet of paper 5 does not overlap the n-th sheet of paper 5

Figure 5:
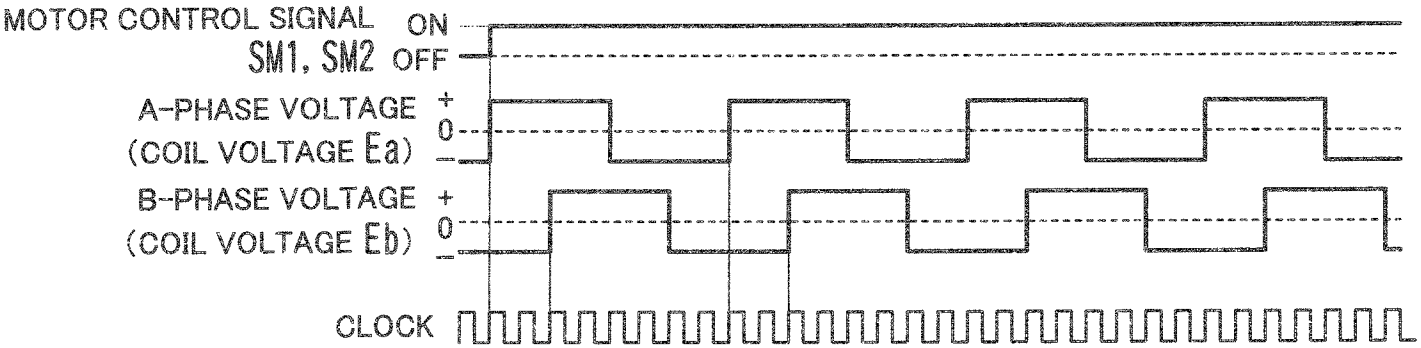
FIG. 5 shows a timing chart for depicting the outline of application of a drive voltage to a motor.
Figure 6:
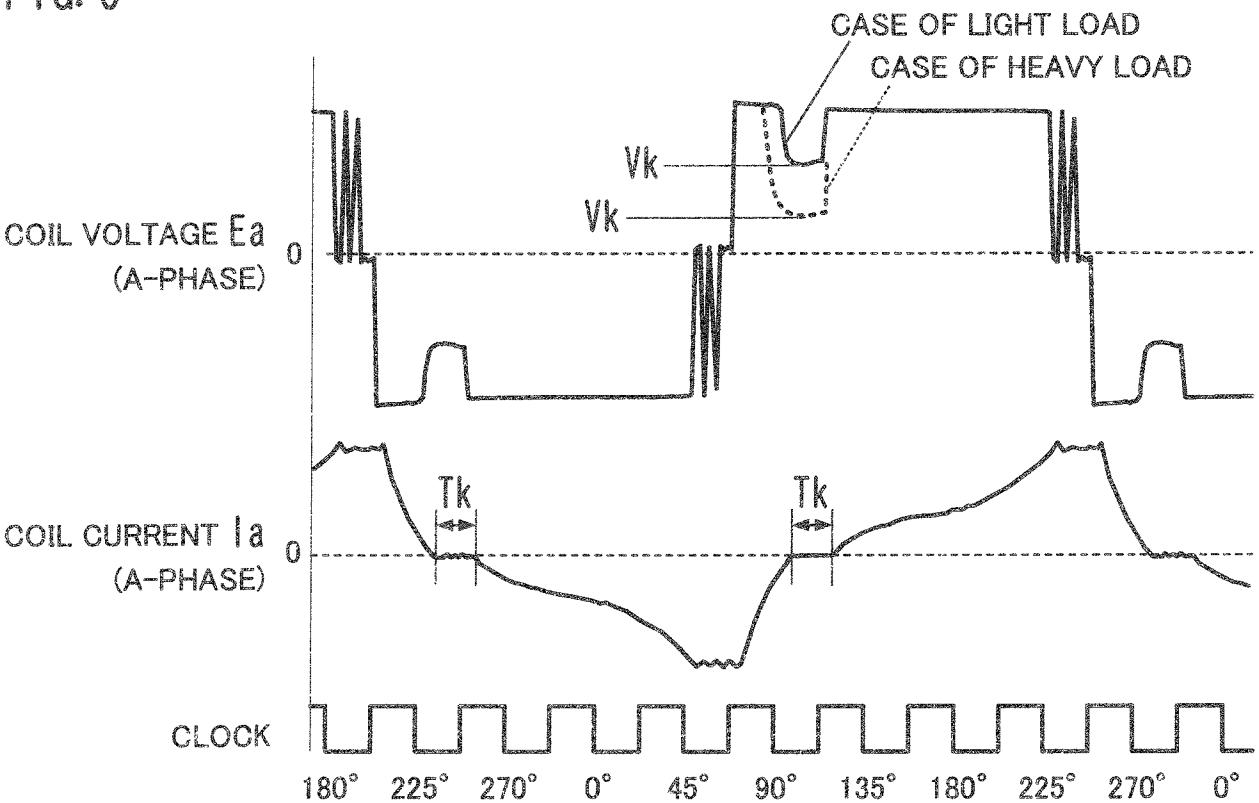
FIG. 6 is a diagram showing an example of waveforms of a coil voltage Ea and a coil current Ia of a motor.

FIG. 5 shows the outline of application of a drive voltage to the motors M1 and M2. FIG. 6 shows an example of waveforms of the coil voltage Ea and a coil current Ia of a motor.

In this embodiment, the motors M1 and M2 which are stepper motors are driven in a so-called 2-phase excitation. To be specific, as shown in FIG. 5, over a period in which the motor control signals SM1 and SM2 are turned ON, AC voltages (Ea and Eb) are applied to the A-phase coil 42 and the B-phase coil 43, respectively, of each of the motors M1 and M2 with the phases shifted with each other by 90 degrees. The rotor 41 has a permanent magnet. Therefore, when the polarity of a voltage applied to each of the phase coils is switched and the direction of the coil current is inversed, the rotor 41 rotates in response to a change in magnetic field involved with the inversion. The motors M1 and M2 rotate one step for every one period of the AC voltage to be applied (8 clocks in the illustrated example). The rotational speed of the motors M1 and M2 depends on the clock frequency.

While the motors M1 and M2 rotate, the magnetic field on the individual coils changes. This generates an induced voltage (back electromotive force) in the A-phase coil 42 and the B-phase coil 43. Stated differently, the coil voltages Ea and Eb during the rotation of the motors M1 and M2 are voltages resulted from superimposing the induced voltage on the voltage applied by the motor drivers 201 and 202.

Referring to FIG. 6, the waveform of the coil voltage Ea changes temporarily from a rectangular shape to a distorted shape during a period Tk in which the coil current Ia is 0 (zero). The distorted waveform is caused by the induced voltage Vk. For example, the output of the motor driver 201 becomes high impedance during the period Tk. This makes the voltage of the output of the motor driver 201 substantially 0 (zero), and only the induced voltage Vk appears as the coil voltage Ea. Therefore, the magnitude of the induced voltage Vk is determined by detecting the value of the coil voltage Ea (voltage level) in the period Tk.

The induced voltage Vk is expressed by the following equation.

$$Vk=Ke\cdot\omega\cdot\cos\theta$$

where Ke represents an induced voltage constant [V·s/rad], ω represents an angular frequency [rad/s], and θ represents a load angle (delay in mechanical angle with respect to electrical angle) [°].

The delay in mechanical angle with respect to electrical angle is larger in the case where a load on the motor M1 or M2 is a heavy load than in the case where the load on the motor M1 or M2 is a light load. To be specific, a load angle θ2 for heavy load is larger than a load angle θ1 for light load. Within a range of 0°<θ1 and θ2<90°, the relationship cos θ1>cos θ2 holds. Accordingly, the absolute value of the induced voltage Vk is smaller for heavy load than for light load as shown in a broken line of FIG. 6.

Figure 7:
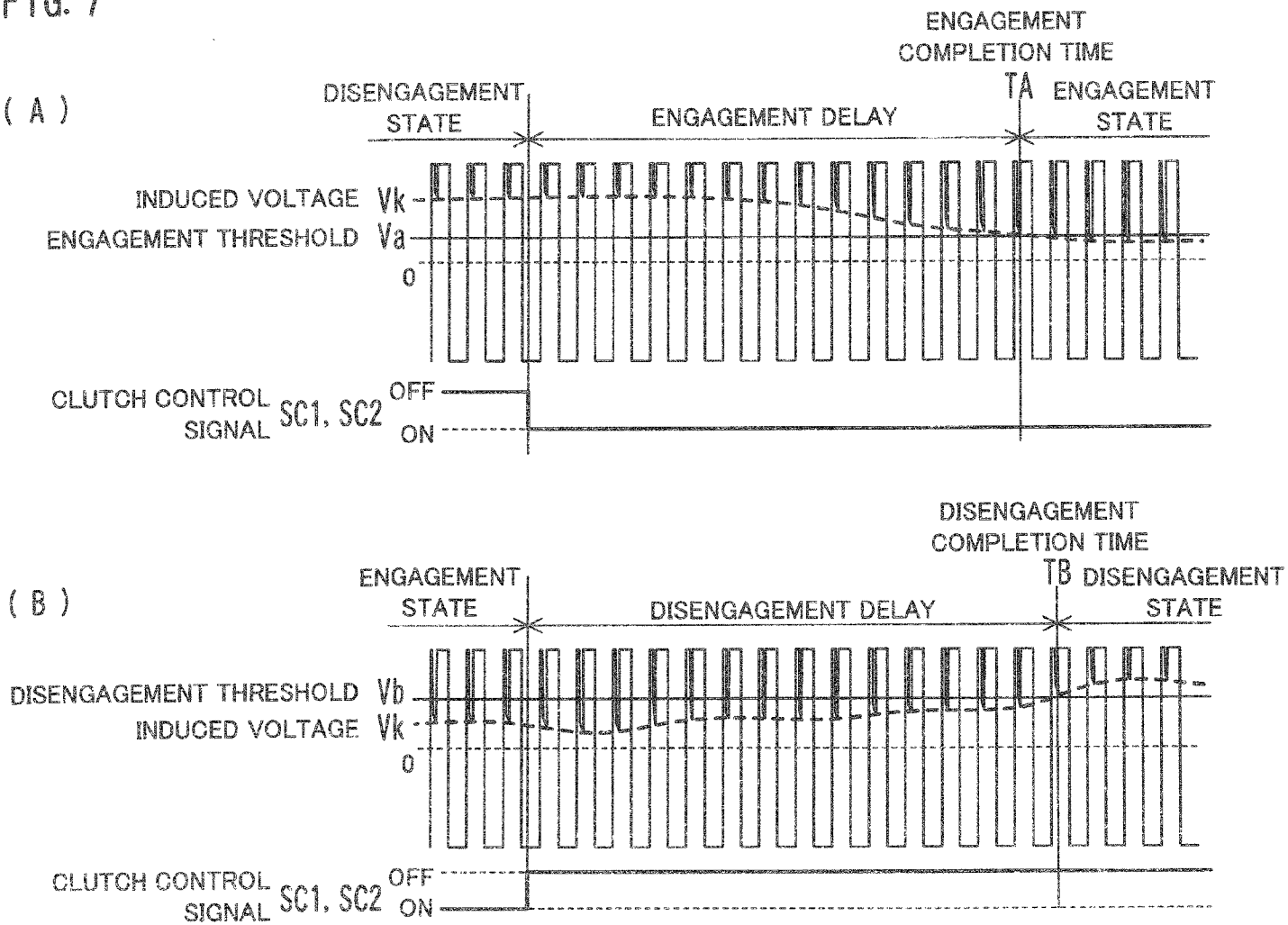
FIGS. 7 (A) and (B) show an example of a method for detecting a time of transition of the state of a clutch based on an induced voltage.

FIGS. 7 (A) and (B) show an example of a method for detecting a time of transition of the state of a clutch based on the induced voltage Vk.

Referring to (A) of FIG. 7, the value of the induced voltage Vk changes from a value larger than an engagement threshold Va which is a first threshold to a value smaller than the engagement threshold Va. The time point for such a change is regarded as the engagement completion time TA. For detection in the paper feed clutch C1, the engagement threshold Va is determined as follows: An experiment for feeding various types of paper 5 is conducted in advance. The magnitude of the induced voltage Vk is checked for the case where a load placed on the motor M1 is a lowest load (minimum load) with the paper feed clutch C1 engaged. The engagement threshold Va is determined based on the check result. For detection in the timing clutch C2, the disengagement threshold Vb is determined as follows: The similar experiment is conducted in advance. The magnitude of the induced voltage Vk is checked for the case where a load placed on the motor M2 is a minimum load with the timing clutch C2 engaged. The disengagement threshold Va is determined based on the check result.

Referring to (B) of FIG. 7, the value of the induced voltage Vk changes from a value smaller than a disengagement threshold Vb which is a second threshold to a value larger than the disengagement threshold Vb. The time point for such a change is regarded as the disengagement completion time TB. For detection in the paper feed clutch C1, the disengagement threshold Vb is determined as follows: The experiment for feeding various types of paper 5 is conducted in advance. The magnitude of the induced voltage Vk is checked for the case where a load placed on the motor M1 is a maximum load with the paper feed clutch C1 engaged. The disengagement threshold Vb is determined based on the check result. For detection in the timing clutch C2, the disengagement threshold Vb is determined as follows: The similar experiment is conducted in advance. The magnitude of the induced voltage Vk is checked for the case where a load placed on the motor M2 is a maximum load with the timing clutch C2 engaged. The disengagement threshold Va is determined based on the check result.

Figure 8:
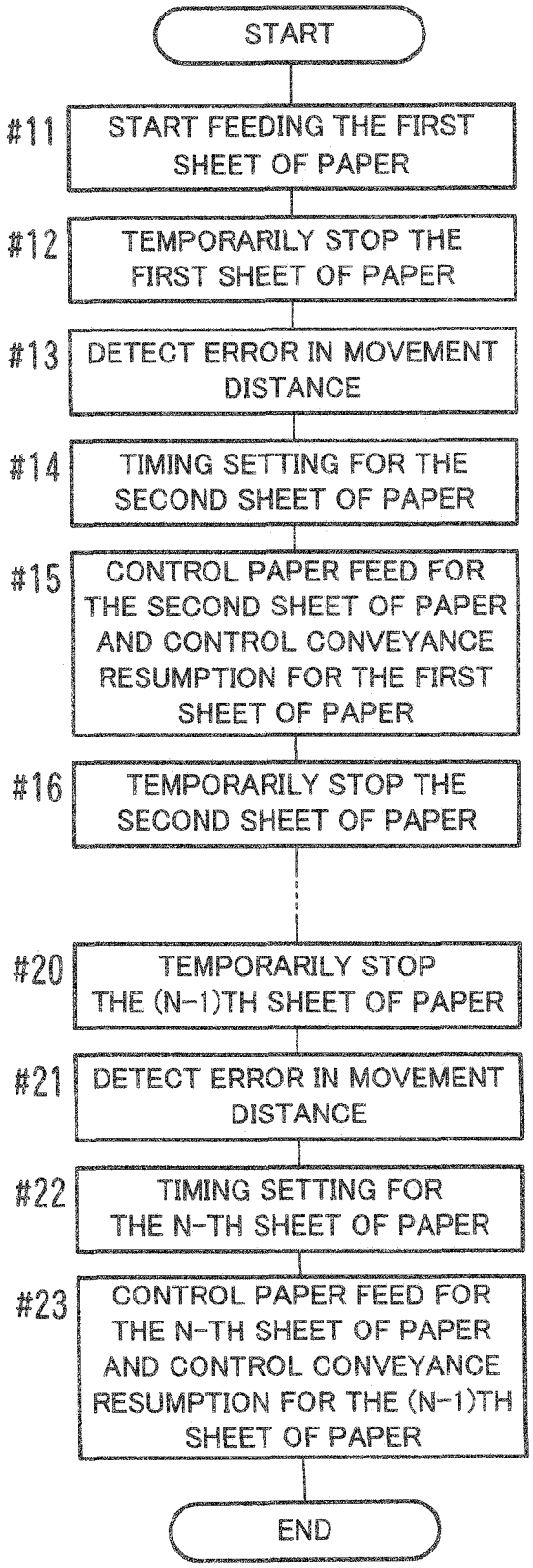
FIG. 8 is a flowchart for depicting an example of the outline of paper feed control for the case of conveying a plurality of sheets of paper.

FIG. 8 is a flowchart for depicting an example of the outline of paper feed control for the case of conveying a plurality of sheets of paper 5. The flow is common to the M-C structure, the C-M structure, and the C-C structure. It is assumed that, in FIG. 8, the number N of sheets of paper 5 is 3 or more. The number N may be 2 or more. When the number N is 2, paper feed control is finished at the start of reconveyance of the second sheet of paper 5 which had been stopped temporarily.

In response to a print job given to the image forming apparatus 1, the CPU 101 performs a control to start feeding the first sheet of paper 5 (Step #11), and temporarily stop the first sheet of paper 5 in the upstream of the transfer position for transfer registration (Step #12).

With respect to the paper feed clutch C1 or the timing clutch C2 used in the steps from paper feed to temporary stop, the engagement completion time TA or the disengagement completion time TB is detected. Based on the detection result, an error in movement distance of the paper 5 is detected as described later (Step #13).

In accordance with the error detected, a time at which the second sheet of paper is fed and a time at which conveyance of the first sheet of paper is resumed (reconveyance) are so set to optimize an inter-sheet space between the first sheet of paper and the second sheet of paper (Step #14).

The second sheet of paper 5 is fed at the set time and the first sheet of paper 5 is reconveyed at the set time (Step #15). The reconveyed first sheet of paper 5 is conveyed to the transfer position, the fixing unit 18, and the paper exit tray 35.

The second sheet of paper 5 fed is temporarily stopped (Step #16). In steps (not shown in the drawing), an error in movement distance is detected in a manner similar to that for the first sheet of paper, so that a time when an inter-sheet space between the second sheet of paper 5 and the third sheet of paper 5 is optimized is set. The third sheet of paper 5 is fed at the set time, and the second sheet of paper 5 is reconveyed at the set time.

The manner similar to that for the second sheet of paper and forward is used to feed sheets of paper from the third sheet to the (N−1)th sheet, and the (N−1)th sheet of paper 5 currently conveyed is temporarily stopped in the upstream of the transfer position (Step #20). An error in the movement distance is detected (Step #21). A time at which an inter-sheet space between the (N−1)th sheet of paper 5 and the N-th sheet of paper is optimized is set (Step #22). The N-th sheet of paper is fed and the (N−1)th sheet of paper 5 is reconveyed (Step #23). Then, the paper feed control for the print job is finished.

Hereinafter, the operation of the image forming apparatus 1 and the control thereof are described in detail for each of the cases of the M-C structure, the C-M structure, and the C-C structure.

[M-C Structure]

Figure 9:
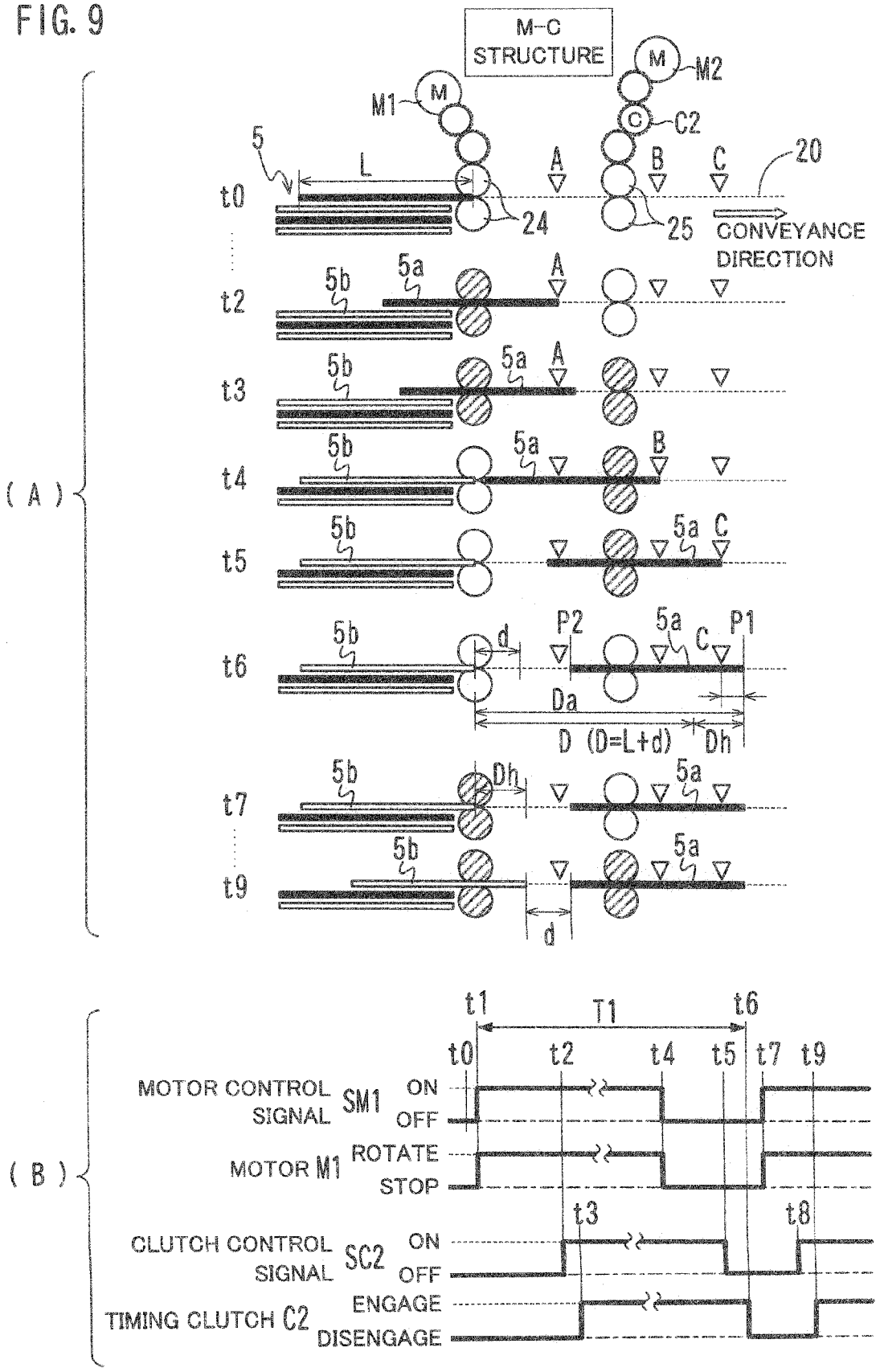
FIGS. 9 (A) and (B) show an example of operation and control by a roller drive mechanism having the M-C structure.

FIGS. 9 (A) and (B) show an example of operation and control by a roller drive mechanism having the M-C structure. To be specific, FIG. 9 shows, in (A), positions of two sheets of paper 5*a* and 5*b* in steps for the case where the paper 5*a* and the paper 5*b* are conveyed in the stated order. FIG. 9 shows, in (B), a control timing.

Referring to (A) of FIG. 9, an odd-numbered sheet of paper, e.g., the paper 5*a*, is denoted by a black elongated rectangle, and an even-numbered sheet of paper 5, e.g., the paper 5*b*, is denoted by a white elongated rectangle. A halted roller is denoted by a white circle. A rotating roller is denoted by a hatched circle. The same is similarly applied to (A) of FIG. 14 and (A) of FIG. 18.

For the M-C structure, three sensors A, B, and C are used to detect the progress of paper conveyance. The sensors A, B, and C are paper sensors which output a signal indicating the presence/absence of paper 5 at the respective installation positions. The sensor A is disposed between the paper feed rollers 24 and the timing rollers 25 on the paper path 20. The sensor B is disposed in the vicinity of the downstream of the timing rollers 25. The sensor C is disposed between the sensor B and the transfer position.

At a time point t0, paper feed is about to start. Paper feed preparation is completed. The leading end of one sheet of paper 5 is fed between the paper feed rollers 24. The motor M1 stops, and the paper feed rollers 24 also stop.

Referring to (B) of FIG. 9, when the motor control signal SM1 switches from OFF to ON at a time point t1, the motor M1 rotates and the paper feed rollers 24 rotate, so that paper feed of the n-th sheet of paper 5*a* immediately starts.

When the paper 5*a* reaches the position of the sensor A to turn ON the sensor A at a time point t2, the clutch control signal SC2 switches from OFF to ON. The switching from OFF to ON is an engagement command given to the timing clutch C2. The timing clutch C2 turns into an engagement state at a time point t3 after receiving the engagement command. The time point t3 is detected by using the engagement threshold Va based on the induced voltage Vk of the motor M2 as described above. The time point t3 is an example of the engagement completion time TA.

The motor M2 rotates at or before the time point t2. The timing rollers 25 rotate at the time point t3. The timing rollers 25 are caused to rotate before the paper 5*a* reaches the timing rollers 25. This makes it possible to take over the conveyance of the paper 5*a* from the paper feed rollers 24 to the timing rollers 25. The position of the sensor A is so selected that such conveyance preparation can be performed appropriately. Since the paper 5*a* has not yet reached the timing rollers 25, the engagement delay in the timing clutch C2 does not influence the conveyance of the paper 5*a*.

When the paper 5*a* reaches the position of the sensor B to turn ON the sensor B at a time point t4, the motor control signal SM1 switches from ON to OFF. The motor M1 stops, and the paper feed rollers 24 also stop. The timing rollers 25, however, keep conveying the paper 5*a*. In parallel with the conveyance of the paper 5*a*, paper feed preparation for the (n+1)-th sheet of paper 5*b* is made.

When the paper 5*a* reaches the position of the sensor C to turn ON the sensor C at a time point t5, the clutch control signal SC2 switches from ON to OFF. The switching from ON to OFF is a disengagement command given to the timing clutch 24.

The timing clutch C2 turns into a disengagement state at a time point t6 after receiving the disengagement command. The time point t6 is detected by using the disengagement threshold Vb based on the induced voltage Vk of the motor M2 as described above. The time point t6 is an example of the disengagement completion time TB.

The timing clutch C2 involves a disengagement delay corresponding to a time between the time point t5 and the time point t6 (disengaging operation time). Thus, when the paper 5*a* stops temporarily at the time point t6, the position P1 of the leading end of the paper 5*a* is in the downstream of the position of the sensor C.

The CPU 101 calculates a movement amount Da based on a conveyance speed V and a movement time T1 from the time point t1 to the time point t6. The movement amount Da is a distance for the paper 5*a* to actually move in a period from the paper feed to the temporary stop. The movement amount Da is obtained by multiplying the movement time T1 and the conveyance speed V together (Da=T1·V). The movement amount Da depends on a disengagement delay in the timing clutch C2. The movement amount Da varies because the disengagement delay varies depending on the individual difference, operational environment, and aging of the timing clutch C2.

The CPU 101 then calculates a difference Dh between the movement amount Da calculated and an optimum movement amount D (Dh=Da−D). The optimum movement amount D is the sum of the length L of the paper 5*a* in the conveyance direction and an optimum inter-sheet space d. The length L of the paper 5*a* is determined based on the paper size designated in the print job. The inter-sheet space d is a numerical value optimized depending on print conditions of paper type, color/monochrome, single-sided printing/double-sided printing, and so on. The inter-sheet space d is determined based on settings of items of the print job.

At a time point t9 at which reconveyance is to be started for transfer, the CPU 101 sets a time point t8 and a time point t7 so that reconveyance of the paper 5*a* actually starts, and the next paper 5*b* is conveyed with the optimum inter-sheet space d provided between the paper 5*a* and the next paper 5*b*.

The time point t8 is a time at which an engagement command is given to the timing clutch C2 for reconveyance. The time point t7 is a time at which paper feed of the (n+1)-th sheet of paper 5*b* is started. The time point t7 and the time point t8 are examples of the command timing.

Referring to (B) of FIG. 9, at the time point t6, a distance between the position P2 of the trailing end of the paper 5*a* and the paper feed rollers 24 is longer than the optimum inter-sheet space d. Thus, before the paper 5*a* is reconveyed, feeding the next paper 5*b* starts. Stated differently, a time point earlier than the time point t9 by a time corresponding to Dh/V is set as the time point t7 so that the paper 5*b* is conveyed to the downstream by the difference Dh between the time point t7 and the time point t9.

Figure 10:
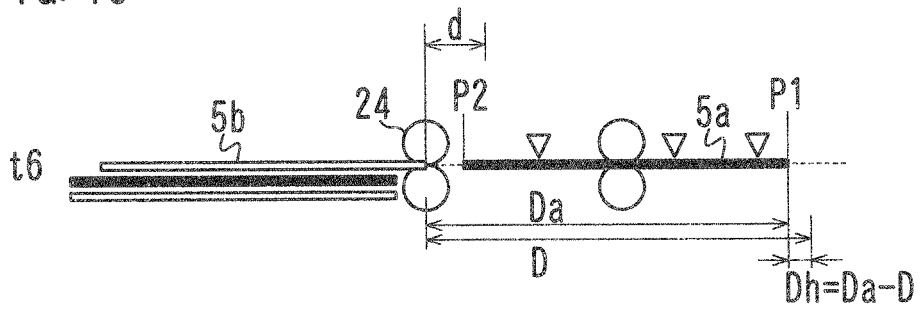
FIG. 10 shows an example of the position of paper which is fed and then temporarily stops.

As shown in FIG. 10, depending on the length L of the paper 5*a*, the distance between the position P2 of the trailing end of the paper 5*a* and the paper feed rollers 24 is shorter than the optimum inter-sheet space d at the time point t6, so that a difference Dh between the movement amount Da and the optimum movement amount D has a negative value. In such a case, the time point t7 is so set that feeding the paper 5*b* starts at a time later than a time when the paper 5*a* is reconveyed.

Figure 11:
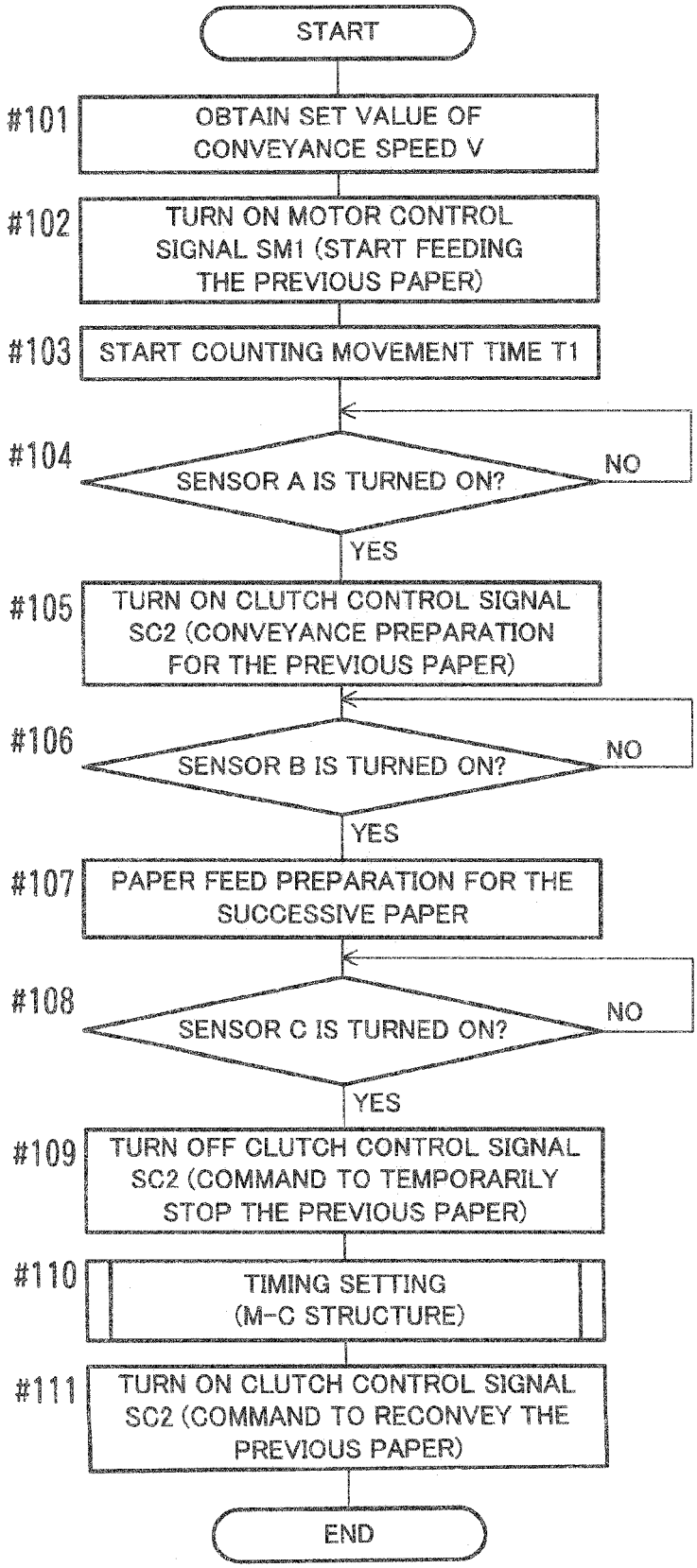
FIG. 11 is a flowchart for depicting an example of paper feed control in the M-C structure.

FIG. 11 depicts an example of paper feed control in the M-C structure.

The conveyance control portion 116 of the CPU 101 obtains, in advance, a set value of the conveyance speed V (Step #101). The conveyance control portion 116 turns ON the motor control signal SM1 to start feeding the n-th sheet of paper 5*a* which is previous paper (Step #102) and to start counting the movement time T1 (Step #103). Instead of counting the time, the conveyance control portion 116 may obtain the current time from a system clock to store the same as the time point t1.

The conveyance control portion 116 waits for the sensor A to be turned ON (Step #104). In response to the sensor A turned ON, the conveyance control portion 116 turns ON the clutch control signal SC2 to rotate the timing rollers 25 as preparation of conveyance of the previous paper (Step #105).

The conveyance control portion 116 waits for the sensor B to be turned ON (Step #106). In response to the sensor B turned ON, the conveyance control portion 116 performs paper feed preparation of the (n+1)-th sheet of paper 5*b* which is successive paper (Step #107).

The conveyance control portion 116 waits for the sensor C to be turned ON (Step #108). In response to the sensor C turned ON, the conveyance control portion 116 switches the clutch control signal SC2 from ON to OFF (Step #109).

Then, a timing setting process is performed (Step #110). The conveyance control portion 116 turns ON the clutch control signal SC2 (Step #111) at the time thus set to reconvey the previous paper.

Figure 12:
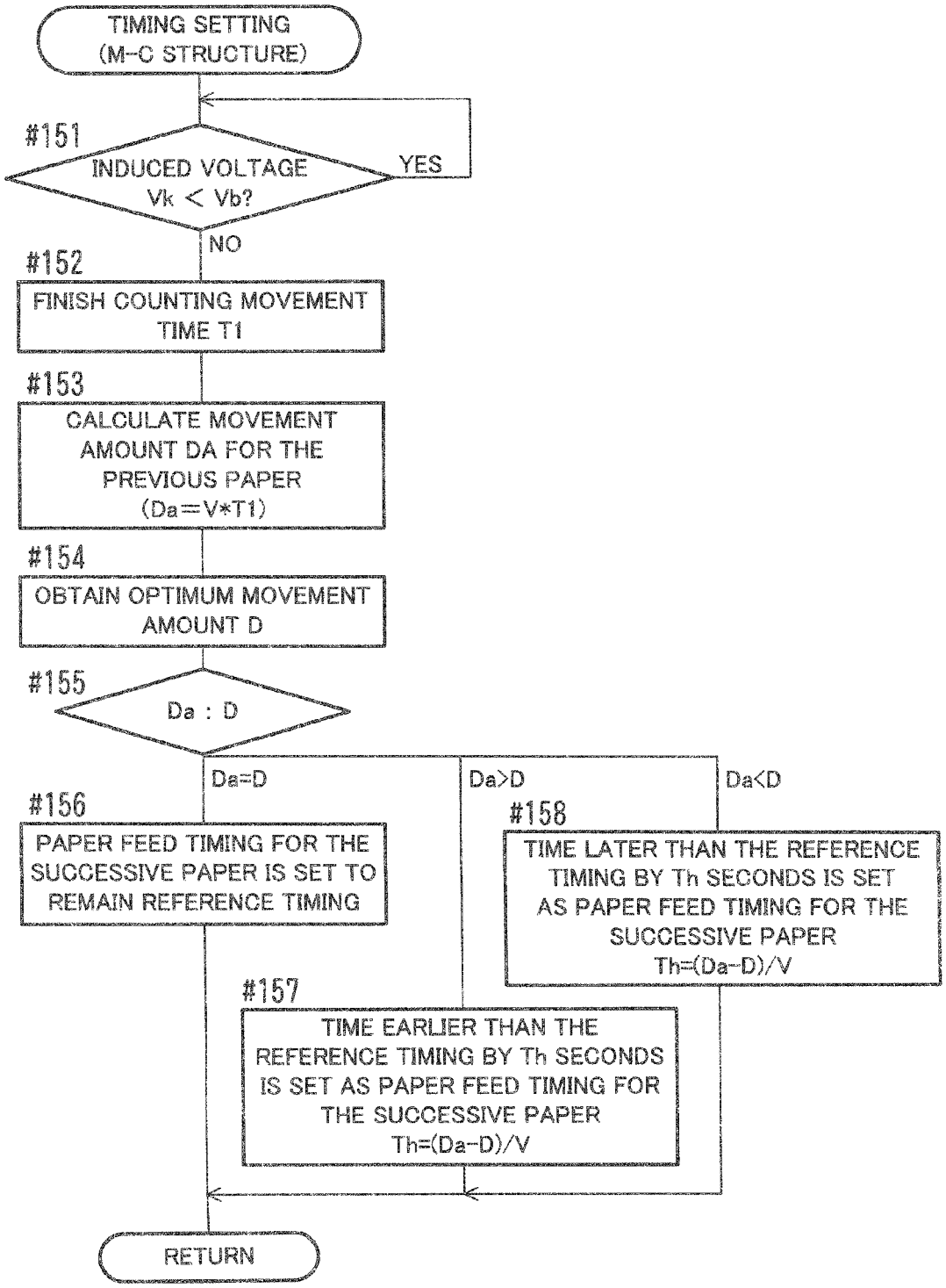
FIG. 12 is a flowchart for depicting an example of a timing setting process in the M-C structure.

FIG. 12 is a flowchart for depicting an example of the timing setting process in the M-C structure of FIG. 11.

The timing detection portion 114 waits until the induced voltage Vk of the motor M2 detected periodically by the induced voltage detection portion 112 becomes greater than the disengagement threshold Vb (Step #151). When detecting the disengagement completion time TB at which the induced voltage Vk becomes greater than the disengagement threshold Vb, the timing detection portion 114 informs the conveyance control portion 116 of the fact.

When being informed the fact that the disengagement completion time TB has been detected, the conveyance control portion 116 finishes counting the movement time T1 (Step #152). When the time point t1 is stored instead of the time count, the conveyance control portion 116 obtains the current time as the time point t6 from the system clock to calculate a time from the time point t1 to the time point t6 as the movement time T1.

The conveyance control portion 116 then calculates the movement amount Da for the previous paper (Step #153), and obtains, from control data stored in advance, the optimum movement amount D depending on setting details of the print job (Step #154).

The conveyance control portion 116 compares the movement amount Da calculated and the optimum movement amount D (Step #155) to set a paper feed timing for the successive paper depending on the magnitude relationship between the movement amount Da and the optimum movement amount D in the following manner.

If the movement amount Da and the optimum movement amount D are equal to each other, then the paper feed timing for the successive paper is set to remain the reference timing determined in advance (Step #156). As to reconveyance of the previous paper, as shown in (B) of FIG. 9, the time point t8 is set as a command timing at which a command is given to the timing clutch C2 to perform engaging operation. The time point t8 comes earlier than the time point t9 by an engagement delay (difference between the time point t2 and the time point t3) for the case where the timing clutch C2 is previously engaged at the time point t2.

If the movement amount Da is greater than the optimum movement amount D, then a time earlier than the reference timing by Th seconds is set as the paper feed timing for the successive paper (Step #157). Herein, "Th seconds" are the time obtained by dividing the difference Dh between the movement amount Da and the optimum movement amount D by the conveyance speed V. In this case also, the command timing for reconveying the previous paper is determined in the same manner as that in Step #156.

If the movement amount Da is smaller than the optimum movement amount D, then a time later than the reference timing by Th seconds is set as the paper feed timing for the successive paper (Step #158). In this case also, the command timing for reconveying the previous paper is determined in the same manner as that in Step #156.

As described above, the paper feed timing for the successive paper is set ahead or behind depending on the movement amount Da. Thereby, an inter-sheet space between the previous paper and the successive paper is set at the optimum inter-sheet space d regardless of variations in disengagement delay in the timing clutch C2. This minimizes the inter-sheet space and improves the productivity of printing. As the number of sheets printed is large in a print job, the advantageous effect produced by minimizing the inter-sheet space is large.

Figure 13:
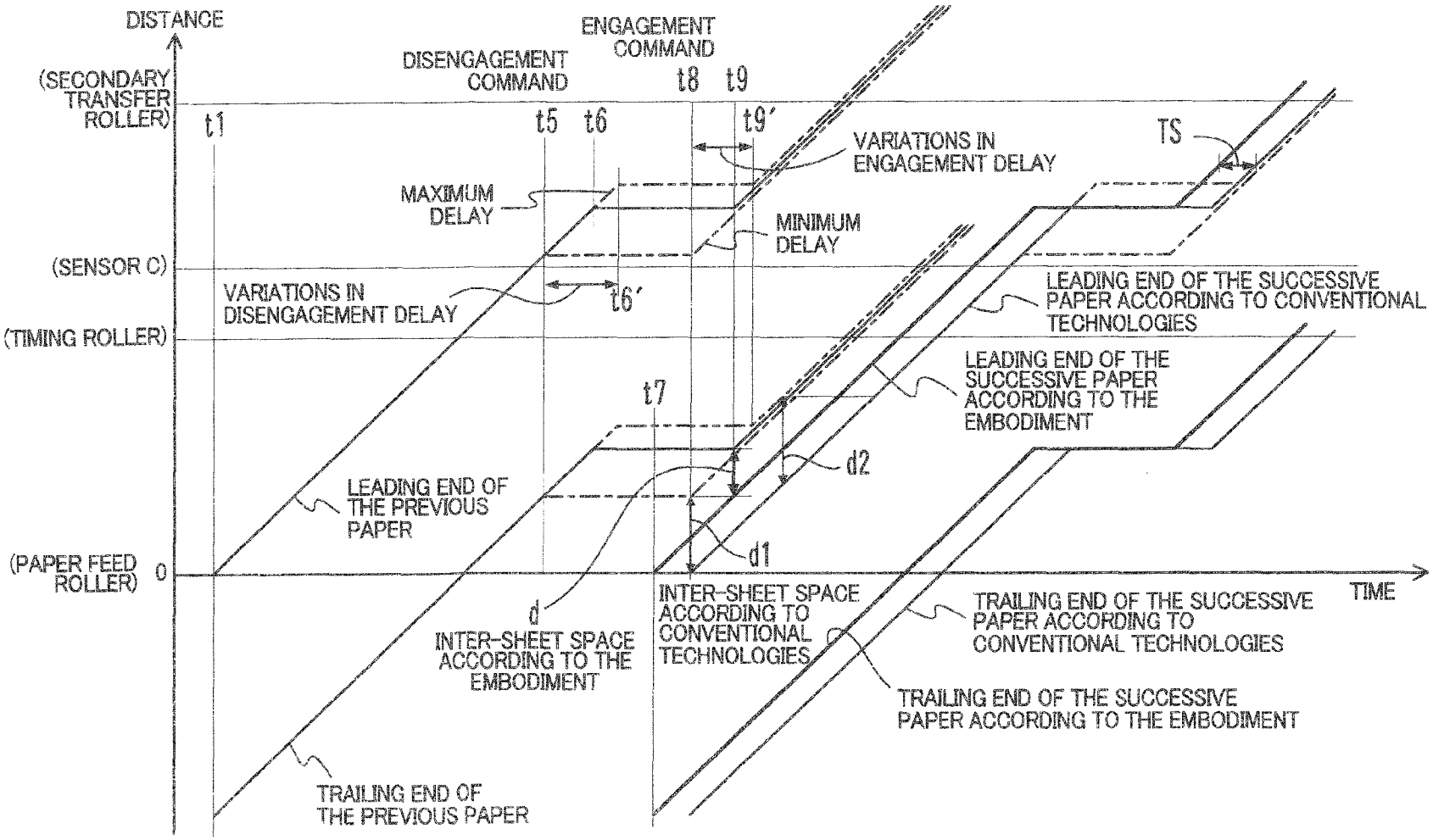
FIG. 13 shows an example of advantages produced by paper feed control in the M-C structure.

FIG. 13 shows an example of advantages produced by paper feed control in the M-C structure. FIG. 13 exemplifies a transition of position of each of the leading and trailing ends of the previous paper and the successive paper. The horizontal axis represents time, and the vertical axis represents a distance away from the position of the paper feed rollers 24. The same is similarly applied to FIGS. 17 and 21.

Referring to FIG. 13, at the time point t1, the leading end of the previous paper is positioned at the paper feed rollers 24. The previous paper moves at a constant speed from the time point t1 to the time point t5 at which a disengagement command is given to the timing clutch C2.

As denoted by a dot-dash line in the drawing, in the case where the timing clutch C2 has a disengagement delay of 0 (zero) and an engagement delay of 0 (zero), which is an ideal state, temporary stop of the previous paper starts at the time point t5, and then, the previous paper starts moving again at the time point t8 at which an engagement command is given.

In the case where the timing clutch C2 has a certain amount of disengagement delay (7 ms, for example), as denoted by a solid line in the drawing, temporary stop of the previous paper actually starts at the time point t6 which is later than the time point t5, and then, the previous paper starts moving again at the time point t9 which is later than the time point t8 by a time corresponding to the engagement delay.

In the case where the disengagement delay is the largest delay within a range of the variations (30 ms, for example), as denoted by a double-dot-and-dash line in the drawing, temporary stop of the previous paper actually starts at a time point t6' which is later than the time point t6, and then, the previous paper starts moving again at a time point t9' which is later than the time point t9.

The trailing end of the previous paper is always at an upper stream position compared to the leading end of the previous paper by a paper length.

Meanwhile, a paper feed timing of the successive paper is discussed. In this embodiment, as denoted by a thick line in the drawing, the successive paper starts to be fed at the time point t7 in such a manner that a distance between the trailing end of the previous paper and the leading end of the successive paper is the optimum inter-sheet space d at the time point t9 at which the previous paper actually starts moving again.

In contrast, according to conventional technologies, paper feed of the successive paper starts at, for example, the time point t8. In such a case, however, inter-sheet spaces are different due to variations in disengagement delay and engagement delay. FIG. 13 shows an inter-sheet space d1 for the case where each of the disengagement delay and the engagement delay has a lowest value and an inter-sheet space d2 for the case where each of the disengagement delay and the engagement delay has a largest value. Each of the inter-sheet space d1 and the inter-sheet space d2 is greater than the optimum inter-sheet space d in this embodiment. In short, according to the conventional technologies, the successive paper is conveyed with the excessively large inter-sheet spaces d1 and d2 provided.

According to the embodiment, it is possible to expedite, by a time TS, the completion of paper discharge of each of the second sheet of paper and beyond.

[C-M Structure]

Figure 14:
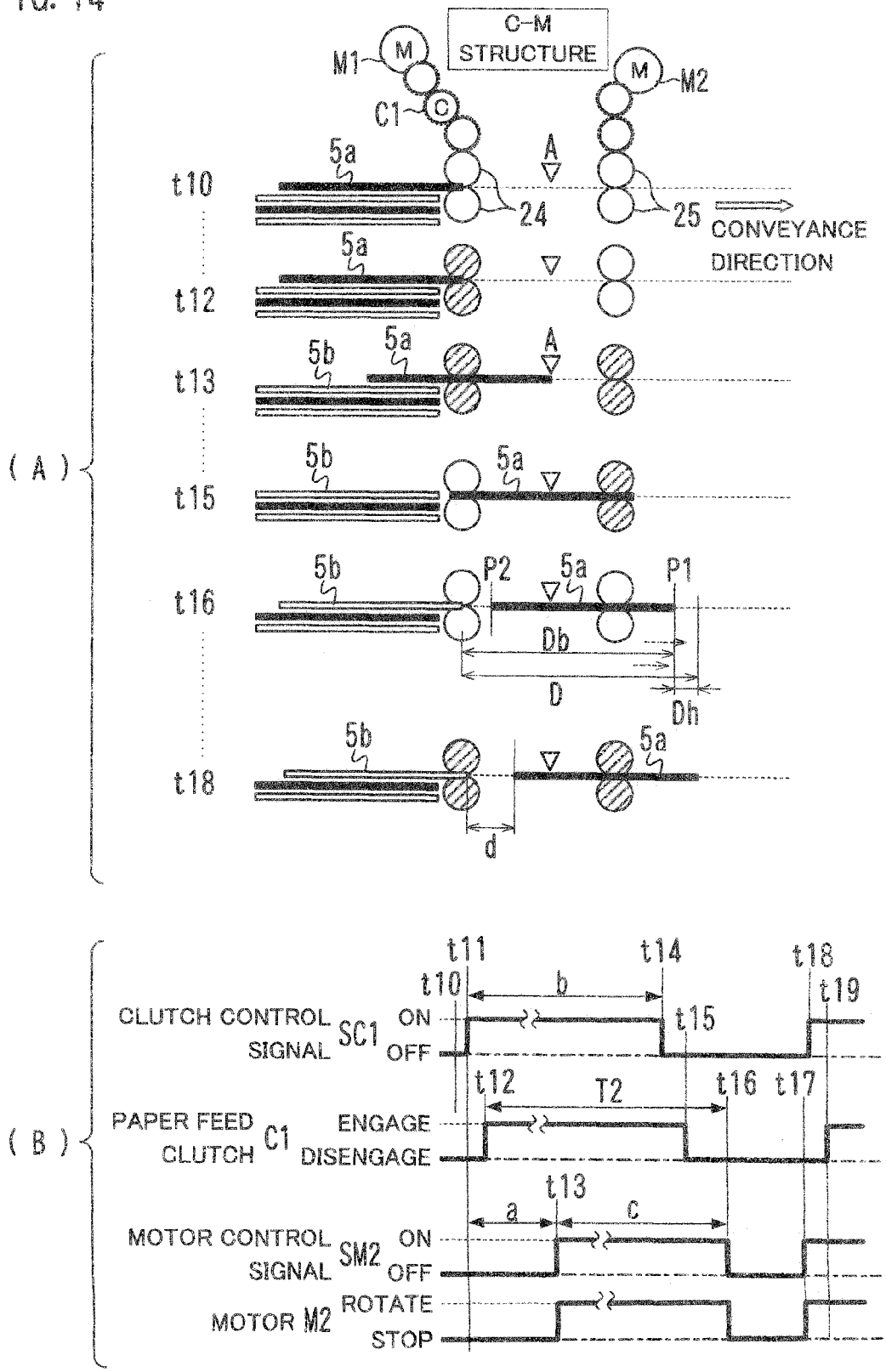
FIGS. 14 (A) and (B) show an example of operation and control by a roller drive mechanism having the C-M structure.

FIGS. 14 (A) and (B) show an example of operation and control by a roller drive mechanism having the C-M structure. To be specific, FIG. 14 shows, in (A), positions of the two sheets of paper 5*a* and paper 5*b* in steps for the case where the paper 5*a* and the paper 5*b* are conveyed in the stated order. FIG. 14 shows, in (B), a control timing.

For the C-M structure, only the sensor A of the three sensors A, B, and C is used. Alternatively, none of the three sensors A, B, and C is used.

At a time point t10, paper feed preparation is completed. The leading end of the n-th sheet of paper 5*a*, which is previous paper, is fed between the paper feed rollers 24. The motor M1 stops, and the paper feed rollers 24 also stop.

Referring to (B) of FIG. 14, at a time point t11, the clutch control signal SC1 switches from OFF to ON. The switching from OFF to ON is an engagement command given to the paper feed clutch C1. The paper feed clutch C1 turns into an engagement state at a time point t12 after receiving the engagement command. This causes the paper feed rollers 24 to rotate, so that paper feed of the paper 5*a* starts. The time point t12 is detected based on the induced voltage Vk of the motor M1 as described above. The time point t12 is an example of the engagement completion time TA.

When the paper 5*a* reaches the position of the sensor A to turn ON the sensor A at a time point t13, the motor control signal SM2 switches from OFF to ON. The switching from OFF to ON is a rotation command given to the motor M2. For the case where the sensor A is not used, a time at which a predetermined time "a" has elapsed since the time point t11 is used as the time point t13. When receiving the rotation command, the motor M2 starts rotating at a constant speed.

At a time point t14 at which a predetermined time "b" has elapsed since the time point t11, the clutch control signal SC1 switches from ON to OFF. At a time point t15 later than the time point t14, the paper feed clutch C1 turns into a disengagement state and the paper feed rollers 24 stop. The timing rollers 25, however, keep conveying the paper 5*a*. In parallel with the conveyance of the paper 5*a*, paper feed preparation for the (n+1)-th sheet of paper 5*b*, which is successive paper, is made.

The time point t15 is detected by using the disengagement threshold Vb based on the induced voltage Vk of the motor M1 as described above. The time point t15 is an example of the disengagement completion time TB.

At a time point t16 at which a predetermined time "c" has elapsed since the time point t13, the motor control signal SM2 switches from ON to OFF. The motor M2 stops, and the timing rollers 25 also stop. This starts temporary stop of the paper 5*a*.

The paper feed clutch C1 involves an engagement delay corresponding to a time between the time point t11 and the time point t12 (engaging operation time). Thus, when the paper 5*a* stops temporarily at the time point t16, the position P1 of the leading end of the paper 5*a* differs depending on variations in engagement delay.

The CPU 101 calculates a movement amount Db based on the conveyance speed V and a movement time T2 from the time point t12 to the time point t16. The movement amount Db is a distance for the paper 5*a* to actually move in a period from the paper feed to the temporary stop. The movement amount Db is obtained by multiplying the movement time T2 and the conveyance speed V together (Db=T2·V). The movement amount Db depends on an engagement delay in the paper feed clutch C1. The movement amount Db varies because the engagement delay varies depending on the individual difference, operational environment, and aging of the paper feed clutch C1.

The CPU 101 then calculates a difference Dh between the movement amount Db calculated and the optimum movement amount D (Dh=Db−D). As described earlier, the optimum movement amount D is the sum of the length L of the paper 5*a* in the conveyance direction and the optimum inter-sheet space d.

At a time point t17 at which reconveyance is to be started for transfer, the CPU 101 sets a time point t18 and a time point t19 so that reconveyance of the paper 5*a* actually starts, and the next paper 5*b* is fed with the optimum inter-sheet space d provided between the paper 5*a* and the next paper 5*b*.

The time point t18 is a time at which an engagement command is given to the paper feed clutch C1 for paper feed of the paper 5*b*. The time point t19 is a time at which the paper feed clutch C1 turns into the engagement state and paper feed of the (n+1)-th sheet of paper 5*b* is started actually by using the paper feed rollers 24.

Referring to (A) of FIG. 14, at the time point t16, a distance between the position P2 of the trailing end of the paper 5*a* and the paper feed rollers 24 is shorter than the optimum inter-sheet space d. Thus, after the paper 5*a* is reconveyed, actual paper feed of the next paper 5*b* starts. Stated differently, a time point later than the time point t17 by a time corresponding to Dh/V is set as the time point t19 so that actual paper feed of the paper 5*b* starts at a time when the paper 5*a* is conveyed to the downstream by the difference Dh. The time point t18 is set to be earlier than the time point t19 by the engagement delay.

Figure 15:
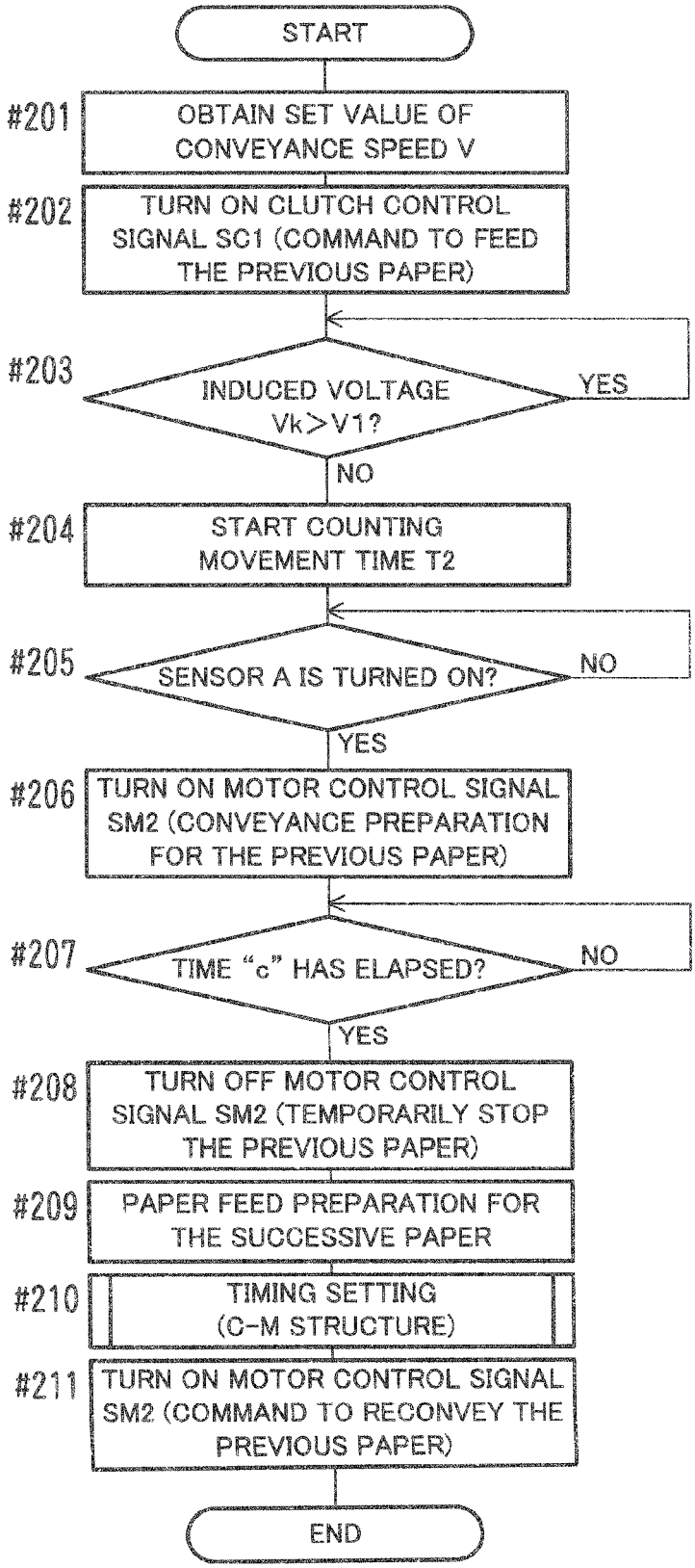
FIG. 15 is a flowchart for depicting an example of paper feed control in the C-M structure.

FIG. 15 depicts an example of paper feed control in the C-M structure.

The conveyance control portion 116 of the CPU 101 obtains, in advance, a set value of the conveyance speed V (Step #201). The conveyance control portion 116 turns ON the clutch control signal SC1 in order to feed the n-th sheet of paper 5*a* which is previous paper (Step #202).

The timing detection portion 114 waits until the induced voltage Vk of the motor M1 periodically detected by the induced voltage detection portion 112 becomes smaller than the engagement threshold Va (Step #203). When detecting an engagement completion time TA at which the induced voltage Vk becomes smaller than the engagement threshold Va, the timing detection portion 114 informs the conveyance control portion 116 of the fact.

When being informed that the engagement completion time TA has been detected, the conveyance control portion 116 starts counting the movement time T2 (Step #204). As with the example described earlier, it is possible to store the current time.

The conveyance control portion 116 waits for the sensor A to be turned ON (Step #205). In response to the sensor A turned ON, the conveyance control portion 116 turns ON the motor control signal SM2 to rotate the timing rollers 25 as preparation of conveyance of the previous paper (Step #206). For the case where the sensor A is not used, the conveyance control portion 116 waits for the time "a" to elapse. When the elapsed time reaches the time "a", the conveyance control portion 116 turns ON the motor control signal SM2.

The conveyance control portion 116 then waits for the time "c" to elapse (Step #207). When the elapsed time reaches the time "c", the conveyance control portion 116 turns OFF the motor control signal SM2 and stops the paper 5*a* temporarily (Step #208), and performs paper feed preparation of the (n+1)-th sheet of paper 5*b* which is successive paper (Step #209).

Then, a timing setting process is performed (Step #210). The conveyance control portion 116 turns ON the motor control signal SM2 (Step #211) at the time thus set to reconvey the previous paper.

Figure 16:
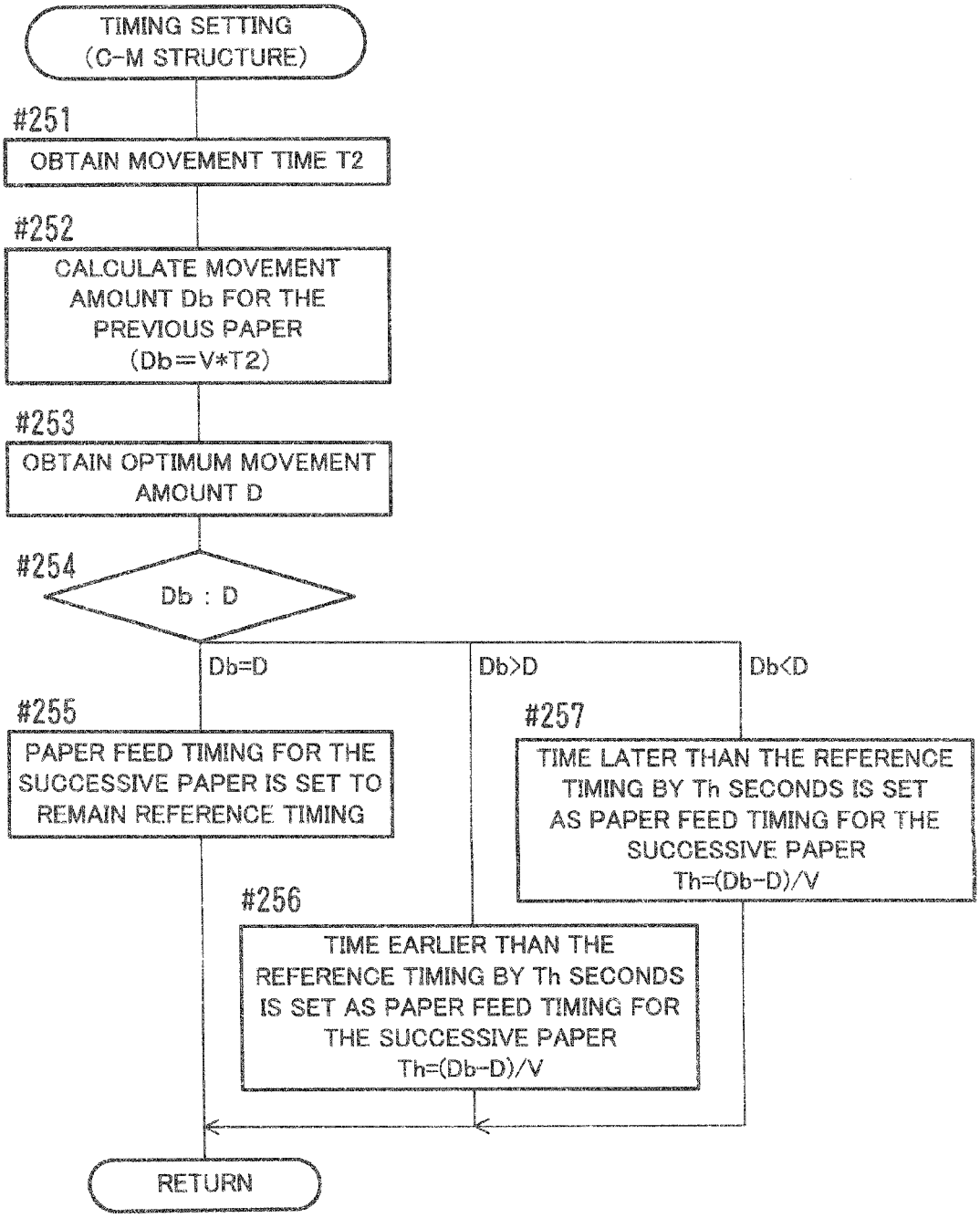
FIG. 16 is a flowchart for depicting an example of a timing setting process in the C-M structure.

FIG. 16 is a flowchart for depicting an example of the timing setting process in the C-M structure of FIG. 15.

The conveyance control portion 116 obtains the movement time T2 (Step #251), calculates the movement amount Db for the previous paper (Step #252), and obtains the optimum movement amount D (Step #253).

The conveyance control portion 116 compares the movement amount Db calculated and the optimum movement amount D (Step #254) to set a paper feed timing for the successive paper depending on the magnitude relationship between the movement amount Db and the optimum movement amount D in the following manner.

If the movement amount Db and the optimum movement amount D are equal to each other, then the paper feed timing for the successive paper is set to remain the reference timing (Step #255).

If the movement amount Db is greater than the optimum movement amount D, then a time earlier than the reference timing by Th seconds is set as the paper feed timing for the successive paper (Step #256). Herein, "Th seconds" are the time obtained by dividing the difference Dh between the movement amount Db and the optimum movement amount D by the conveyance speed V.

If the movement amount Db is smaller than the optimum movement amount D, then a time later than the reference timing by Th seconds is set as the paper feed timing for the successive paper (Step #158).

As described above, the paper feed timing for the successive paper is set ahead or behind depending on the movement amount Db. Thereby, an inter-sheet space between the previous paper and the successive paper is set at the optimum inter-sheet space d regardless of variations in engagement delay in the paper feed clutch C1. This minimizes the inter-sheet space and improves the productivity of printing. As the number of sheets printed is large in a print job, the advantageous effect produced by minimizing the inter-sheet space is large.

Figure 17:
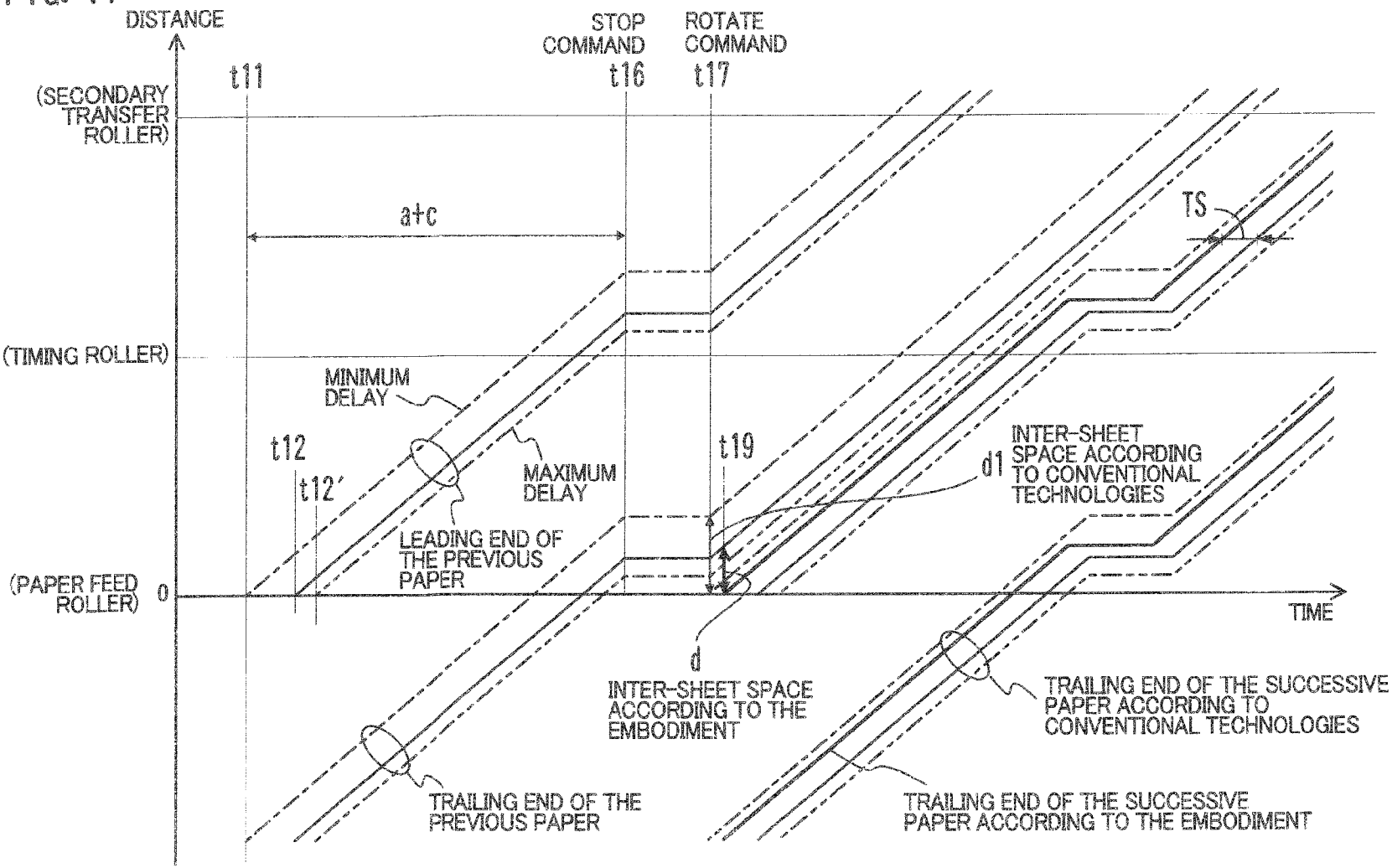
FIG. 17 shows an example of advantages produced by paper feed control in the C-M structure.

FIG. 17 shows an example of advantages produced by paper feed control in the C-M structure.

Referring to FIG. 17, at the time point t11, the leading end of the previous paper is positioned at the paper feed rollers 24. As denoted by a dot-dash line in the drawing, in the case where the paper feed clutch C1 has a minimum engagement delay, the previous paper moves at a constant speed from the time point t11 to the time point t16 at which a stop command is given to the motor M2. The previous paper stops temporarily at the time point t16, and then, starts moving again at the time point t17 at which a rotate command is given to the motor M2.

In the case where the paper feed clutch C1 has a certain amount of engagement delay, as denoted by a solid line in the drawing, the previous paper starts moving at the time point t12 later than the time point t11. In the case where the disengagement delay is largest, as denoted by a double-dot-and-dash line in the drawing, the previous paper starts moving at a time point t12' later than the time point t12. The time point t16 and the time point t17 at which the temporary stop and the reconveyance are stared respectively are the same regardless of the magnitude of the engagement delay.

Meanwhile, a paper feed timing of the successive paper is discussed. In this embodiment, as denoted by a thick line in the drawing, the successive paper actually starts to be fed at the time point t19 in such a manner that a distance between the trailing end of the previous paper and the leading end of the successive paper is the optimum inter-sheet space d after the previous paper moves again at the time point t17.

In contrast, according to conventional technologies, paper feed of the successive paper starts at, for example, the time point t17. In such a case, however, inter-sheet spaces are different due to variations in engagement delay. Sheets of paper sometimes overlap each other due to the excessive short inter-sheet spaces. FIG. 17 shows an inter-sheet space d1 for the case where the engagement delay has a lowest value. The inter-sheet space d1 is greater than the optimum inter-sheet space d in this embodiment. In short, according to the conventional technologies, the successive paper is conveyed with the excessively large inter-sheet space d1 provided.

According to the embodiment, it is possible to expedite, by a time TS, the completion of paper discharge of each of the second sheet of paper and beyond.

[C-C Structure]

Figure 18:
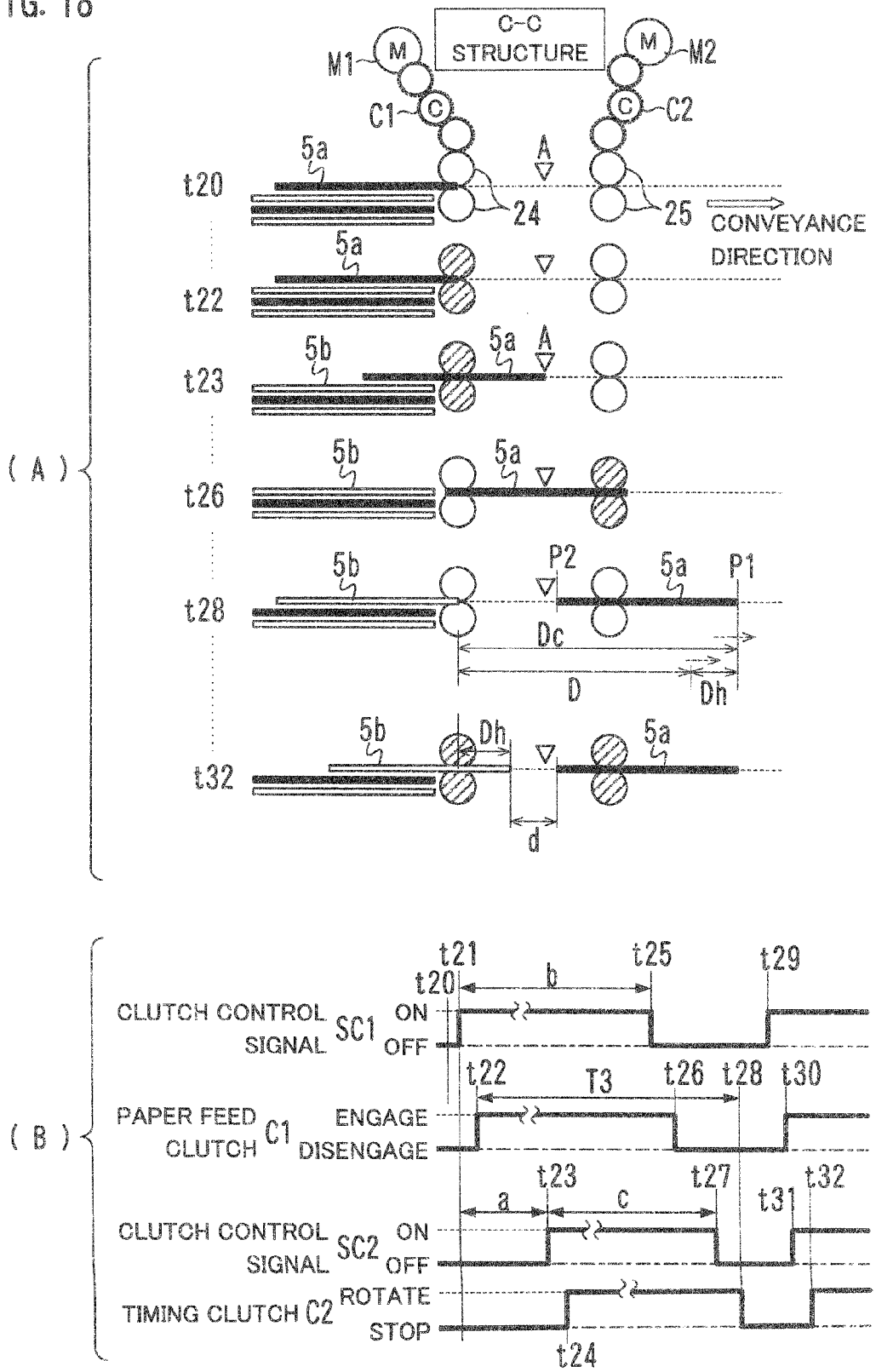
FIGS. 18 (A) and (B) show an example of operation and control by a roller drive mechanism having the C-C structure.

FIGS. 18 (A) and (B) show an example of operation and control by a roller drive mechanism having the C-C structure.

For the C-C structure, only the sensor A of the three sensors A, B, and C is used. Alternatively, none of the three sensors A, B, and C is used.

At a time point t20, paper feed preparation is completed. The leading end of the n-th sheet of paper 5*a*, which is previous paper, is fed between the paper feed rollers 24. The motor M1 stops, and the paper feed rollers 24 also stop.

Referring to (B) of FIG. 18, at a time point t21, the clutch control signal SC1 switches from OFF to ON. The switching from OFF to ON is an engagement command given to the paper feed clutch C1. The paper feed clutch C1 turns into an engagement state at a time point t22 after receiving the engagement command. This causes the paper feed rollers 24 to rotate, so that paper feed of the paper 5*a* starts. The time point t22 is detected by using the engagement threshold Va based on the induced voltage Vk of the motor M1 as described above. The time point t22 is an example of the engagement completion time TA.

When the paper 5*a* reaches the position of the sensor A to turn ON the sensor A at a time point t23, the clutch control signal SC2 switches from OFF to ON. The switching from OFF to ON is an engagement command given to the timing clutch C2. For the case where the sensor A is not used, a time at which the predetermined time "a" has elapsed since the time point t21 is used as the time point t23.

The timing clutch C2 turns into an engagement state at a time point t24 later than a time at which the engagement command is given. The time point t24 is detected by using the engagement threshold Va based on the induced voltage Vk of the motor M2. The time point t24 is an example of the engagement completion time TA.

At a time point t25 at which the predetermined time "b" has elapsed since the time point t21, the clutch control signal SC1 switches from ON to OFF. At a time point t26 later than the time point t25, the paper feed clutch C1 turns into a disengagement state and the paper feed rollers 24 stop. The timing rollers 25, however, keep conveying the paper 5*a*. In parallel with the conveyance of the paper 5*a*, paper feed preparation for the (n+a)-th sheet of paper 5*b*, which is successive paper, is made.

The time point t26 is detected by using the disengagement threshold Vb based on the induced voltage Vk of the motor M1. The time point t26 is an example of the disengagement completion time TB.

At a time point t27 at which the predetermined time "c" has elapsed since the time point t23, the clutch control signal SC2 switches from ON to OFF. At a time point t28 later than the time point t27, the timing clutch C2 turns into a disengagement state, so that the timing rollers 25 stop. This starts temporary stop of the paper 5*a*.

The time point t28 is detected by using the disengagement threshold Vb based on the induced voltage Vk of the motor M2. The time point t28 is an example of the disengagement completion time TB.

When the paper 5*a* stops temporarily at the time point t28, the position P1 of the leading end of the paper 5*a* differs depending on variations in engagement delay in the paper feed clutch C1 and variations in disengagement delay in the timing clutch C2.

The CPU 101 calculates a movement amount Dc based on the conveyance speed V and a movement time T3 from the time point t22 to the time point t28. The movement amount Dc is a distance for the paper 5*a* to actually move in a period from the paper feed to the temporary stop. The movement amount Dc is obtained by multiplying the movement time T3 and the conveyance speed V together (Dc=T3·V).

The CPU 101 then calculates the difference Dh between the movement amount Dc calculated and the optimum movement amount D (Dh=Dc−D).

At a time point t32 at which reconveyance is to be started for transfer, the CPU 101 sets a time point t29, a time point t30, and a time point t31 so that reconveyance of the paper 5*a* actually starts, and the next paper 5*b* is fed with the optimum inter-sheet space d provided between the paper 5*a* and the next paper 5*b*.

The time point t29 is a time at which an engagement command is given to the paper feed clutch C1 for paper feed of the paper 5*b*. The time point t30 is a time at which the paper feed clutch C1 turns into the engagement state and paper feed of the (n+1)-th sheet of paper 5*b* is started actually by using the paper feed rollers 24. The time point t31 is a time at which an engagement command is given to the timing clutch C2 in order to reconvey the paper 5*a*.

Referring to (A) of FIG. 18, at the time point t28, a distance between the position P2 of the trailing end of the paper 5*a* and the paper feed rollers 24 is longer than the optimum inter-sheet space d. Thus, prior to the start of reconveyance of the paper 5*a*, actual paper feed of the next paper 5*b* starts. Stated differently, a time point earlier than the time point t32 by a time corresponding to Dh/V is set as the time point t30 so that the paper 5*b* is conveyed to the downstream by the difference Dh during a period from the time point t28 to the time point t32.

Figure 19:
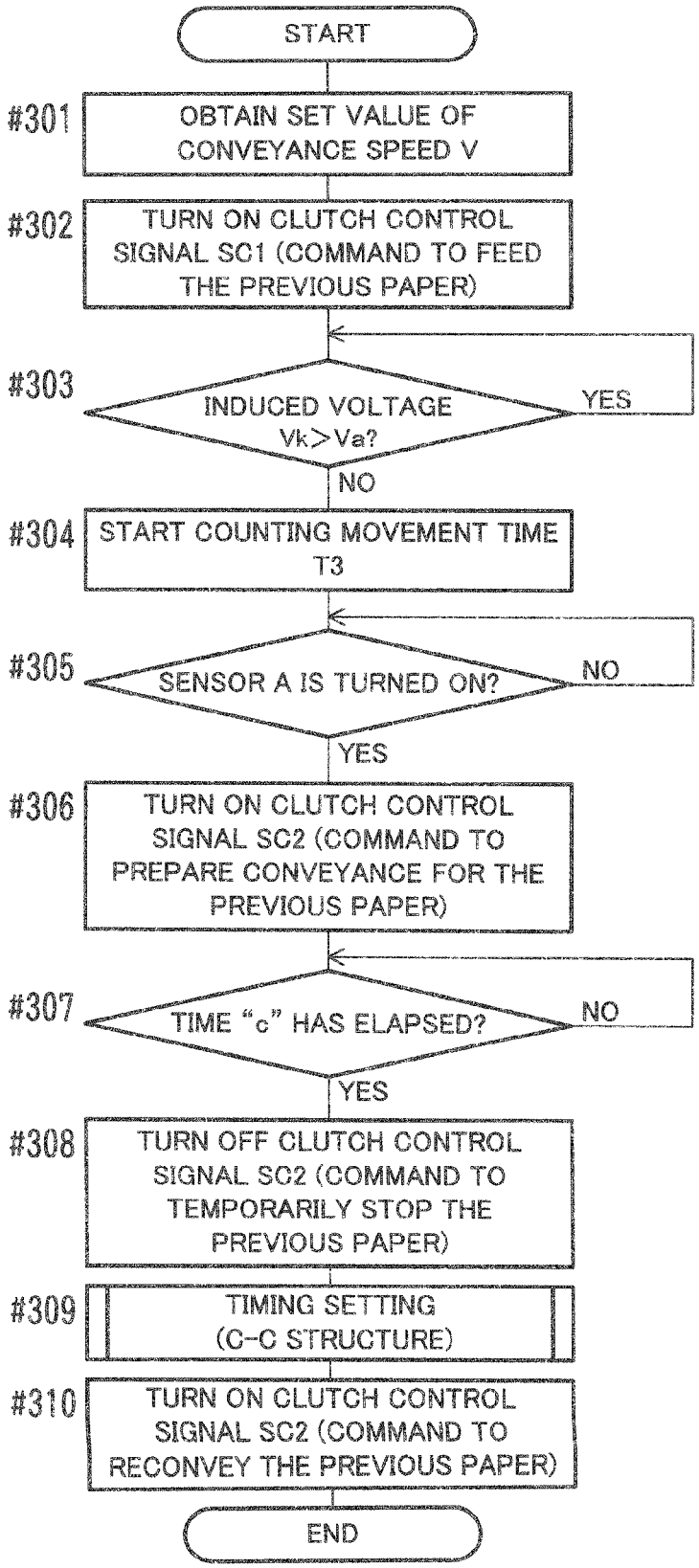
FIG. 19 is a flowchart for depicting an example of paper feed control in the C-C structure.

FIG. 19 depicts an example of paper feed control in the C-C structure.

The conveyance control portion 116 of the CPU 101 obtains, in advance, a set value of the conveyance speed V (Step #301). The conveyance control portion 116 turns ON the clutch control signal SC1 in order to feed the n-th sheet of paper 5*a* which is previous paper (Step #302).

The timing detection portion 114 waits until the induced voltage Vk of the motor M1 periodically detected by the induced voltage detection portion 112 becomes smaller than the engagement threshold Va (Step #303). When detecting an engagement completion time TA at which the induced voltage Vk becomes smaller than the engagement threshold Va, the timing detection portion 114 informs the conveyance control portion 116 of the fact.

When being informed that the engagement completion time TA has been detected, the conveyance control portion 116 starts counting the movement time T3 (Step #304). As with the example described earlier, it is possible to store the current time.

The conveyance control portion 116 waits for the sensor A to be turned ON (Step #305). In response to the sensor A turned ON, the conveyance control portion 116 turns ON the clutch control signal SC2 to rotate the timing rollers 25 as preparation of conveyance of the previous paper (Step #306). For the case where the sensor A is not used, the conveyance control portion 116 waits for the time "a" to elapse. When the elapsed time reaches the time "a", the conveyance control portion 116 turns ON the clutch control signal SC2.

The conveyance control portion 116 then waits for the time "c" to elapse (Step #307). When the elapsed time reaches the time "c", the conveyance control portion 116 turns OFF the clutch control signal SC2 and stops the paper 5*a* temporarily (Step #308).

Then, a timing setting process is performed (Step #309). The conveyance control portion 116 turns ON the clutch control signal SC2 at the time thus set (Step #310).

Figure 20:
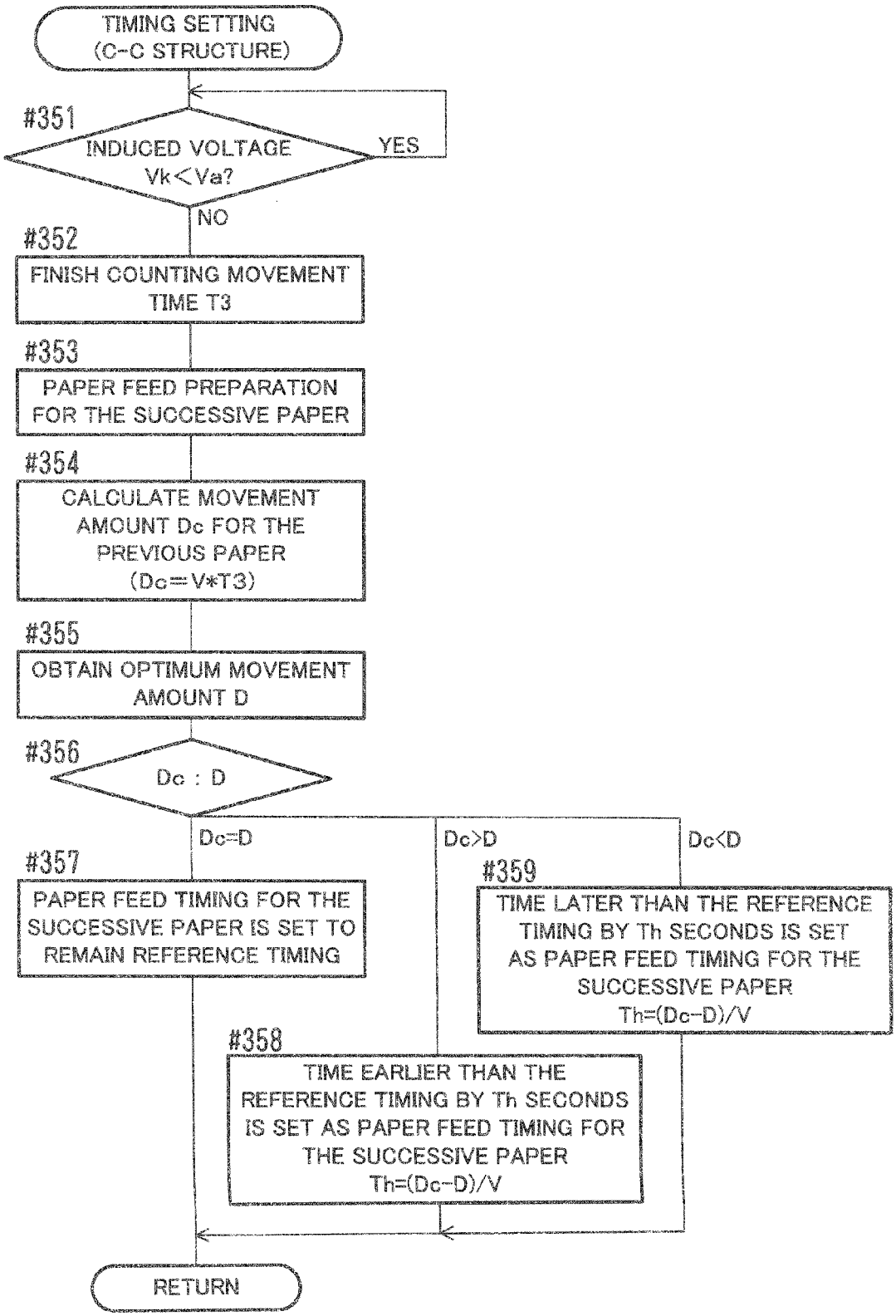
FIG. 20 is a flowchart for depicting an example of a timing setting process in the C-C structure.

FIG. 20 is a flowchart for depicting an example of the timing setting process in the C-C structure of FIG. 19.

The timing detection portion 114 waits until the induced voltage Vk of the motor M2 detected periodically by the induced voltage detection portion 112 becomes greater than the disengagement threshold Vb (Step #351). When detecting the disengagement completion time TB at which the induced voltage Vk becomes greater than the disengagement threshold Vb, the timing detection portion 114 informs the conveyance control portion 116 of the fact.

When being informed the fact that the disengagement completion time TB has been detected, the conveyance control portion 116 finishes counting the movement time T3 (Step #352). When the time point t22 is stored instead of the time count, the conveyance control portion 116 obtains the current time as the time point t28 from the system clock to calculate a time from the time point t22 to the time point t28 as the movement time T3. The conveyance control portion 116 then performs paper feed preparation for the (n+1)-th sheet of paper 5*b* which is successive paper (Step #353).

The conveyance control portion 116 then calculates the movement amount Dc for the previous paper (Step #354), and obtains the optimum movement amount D (Step #355).

The conveyance control portion 116 compares the movement amount Dc calculated and the optimum movement amount D (Step #356) to set a paper feed timing for the successive paper depending on the magnitude relationship between the movement amount Dc and the optimum movement amount D in the following manner.

If the movement amount Dc and the optimum movement amount D are equal to each other, then the paper feed timing for the successive paper is set to remain the reference timing determined in advance (Step #357). As to reconveyance of the previous paper, the time point t31 is set as a command timing at which a command is given to the timing clutch C2 to perform engaging operation. The time point t31 comes earlier than the time point t32 by an engagement delay (difference between the time point t23 and the time point t24) for the case where the timing clutch C2 is previously engaged at the time point t23.

If the movement amount Dc is greater than the optimum movement amount D, then a time earlier than the reference timing by Th seconds is set as the paper feed timing for the successive paper (Step #358). Herein, "Th seconds" are the time obtained by dividing the difference Dh between the movement amount Dc and the optimum movement amount D by the conveyance speed V. In this case also, the command timing for reconveying the previous paper is determined in the same manner as that in Step #357.

If the movement amount Dc is smaller than the optimum movement amount D, then a time later than the reference timing by Th seconds is set as the paper feed timing for the successive paper (Step #359). In this case also, the command timing for reconveying the previous paper is determined in the same manner as that in Step #357.

As described above, the paper feed timing for the successive paper is set ahead or behind depending on the movement amount Dc. Thereby, an inter-sheet space between the previous paper and the successive paper is set at the optimum inter-sheet space d regardless of variations in engagement delay in the paper feed clutch C1 and variations in disengagement delay in the timing clutch C2. This minimizes the inter-sheet space and improves the productivity of printing. As the number of sheets printed is large in a print job, the advantageous effect produced by minimizing the inter-sheet space is large.

Figure 21:
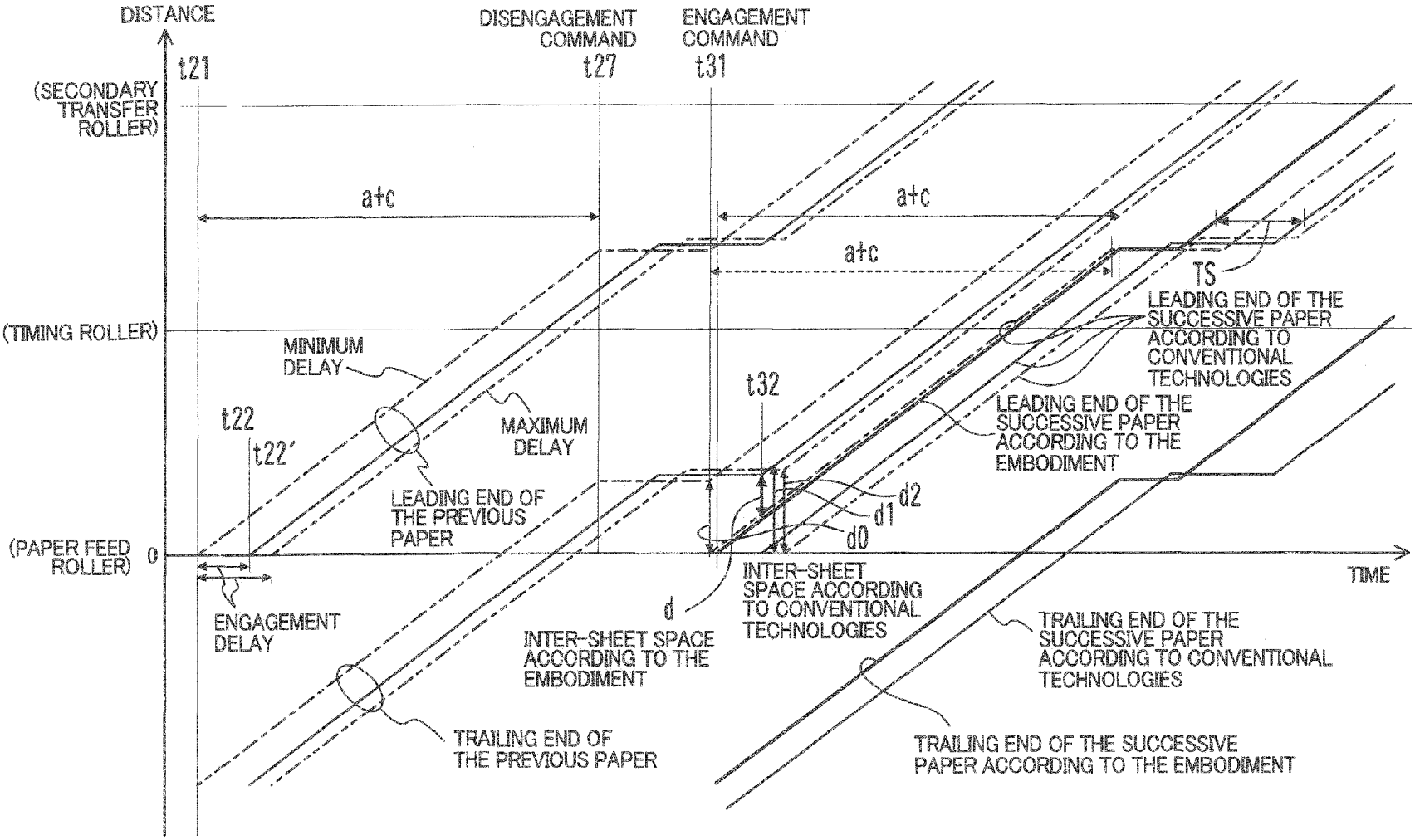
FIG. 21 shows an example of advantages produced by paper feed control in the C-C structure.

FIG. 21 shows an example of advantages produced by paper feed control in the C-C structure.

Referring to FIG. 21, at the time point t21, the leading end of the previous paper is positioned at the paper feed rollers 24. As denoted by a dot-dash line in the drawing, in the case where the paper feed clutch C1 has a minimum engagement delay, the previous paper moves at a constant speed from the time point t21 to the time point t27 at which a disengagement command is given to the timing clutch C2. The previous paper stops temporarily at the time point t27, and then, starts moving again at the time point t31 at which an engagement command is given to the timing clutch C2.

In the case where the paper feed clutch C1 has a certain amount of engagement delay, as denoted by a solid line in the drawing, the previous paper starts moving at the time point t22 later than the time point t21. In the case where the disengagement delay is largest, as denoted by a double-dot-and-dash line in the drawing, the previous paper starts moving at a time point t22' later than the time point t22. Disengagement delay in the timing clutch C2 at the subsequent temporary stop delays a time at which operation is completed in response to a command. Engagement delay in the timing clutch C2 at the subsequent reconveyance delays a time at which operation is completed in response to a command.

Meanwhile, a paper feed timing of the successive paper is discussed. In this embodiment, as denoted by a thick line in the drawing, the successive paper actually starts to be fed at a time point earlier than the time point t32 in such a manner that a distance between the trailing end of the previous paper and the leading end of the successive paper is the optimum inter-sheet space d at a time when the previous paper moves again at the time point t32.

In contrast, according to conventional technologies, paper feed of the successive paper starts at, for example, the time point t31. In such a case, however, inter-sheet spaces are different due to variations in engagement delay. FIG. 21 shows inter-sheet spaces d0, d1, and d2 for three cases where the engagement delays are different from one another. Each of the inter-sheet spaces d1 and d2 is greater than the optimum inter-sheet space d in this embodiment. In short, according to the conventional technologies, the successive paper is conveyed with the excessively large inter-sheet space d1 or d2 provided.

According to this embodiment, it is possible to expedite, by the time TS, the completion of paper discharge of each of the second sheet of paper and beyond. According to the embodiment discussed above, in an image forming apparatus using a synchronous motor and a clutch to convey sheets of paper, it is possible to improve the productivity of printing by reducing an inter-sheet space in conveying sheets of paper, as compared to conventional technologies.

In the foregoing embodiment, the time at which the paper feed of the successive paper 5*b* starts is advanced or delayed depending on the shift of the temporary stop position of the previous paper 5*a* due to one or both of engagement delay and disengagement delay. However, for a print job involving the use of three sheets of paper 5 or more, it is possible to control a time at which the second sheet of paper 5 and beyond (previous paper 5*a* viewed from the third sheet of paper 5 and beyond) stop temporarily instead of controlling a time at which the second sheet of paper 5 and beyond (successive paper 5*b* viewed from the first sheet of paper) are fed. In such a case, the conveyance control portion 116 determines a time at which a disengaging operation command timing is given to the timing clutch C2 at the stop of the paper conveyance in accordance with an engagement completion time at the start of the paper conveyance of the previous paper in such a manner that the stop position of the paper 5 conveyed by the timing rollers 25 falls within a predetermined range.

The magnitude relationship between the induced voltage Vk and each of the engagement threshold Va and the disengagement threshold Vb, and the relationship between disengagement and engagement of the clutch are not limited to the foregoing examples. The magnitude relationship and the relationship may be selected depending on polarities of the coil voltages Ea and Eb in a period during which disengagement and engagement of the clutch is detected. For example, the output impedance of the motor driver 201 or 202 is controlled, so that the coil current Ia is made to have a value of 0 (zero) at any time point to detect the engagement completion time TA or the disengagement completion time TB.

It is to be understood that the configurations of the image forming apparatus 1, the constituent elements thereof, the engagement threshold Va, the disengagement threshold Vb, the number of phases of each of the motors M1 and M2, the type of the clutch, the arrangement of the sensor, the flow of control, and the like can be appropriately modified without departing from the spirit of the present invention.

The foregoing embodiment takes an example in which the image forming apparatus 1 is a printer. The present invention is not limited thereto. The image forming apparatus 1 may be a copier, a facsimile machine, or a multifunction device as long as the device conveys the paper 5 therein. The method for forming an image is not limited to the electrophotography. The image formation method may be an inkjet method or another method.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. An image forming apparatus having a roller for conveying paper, a synchronous motor for rotationally driving the roller, a clutch for transmitting a rotational driving force of the motor to the roller, and a control portion, the image forming apparatus forming an image onto the paper conveyed by the roller, the apparatus comprising:

an induced voltage detection portion configured to detect an induced voltage Vk in the motor; and an engagement/disengagement completion time detection portion configured to detect an engagement completion time and a disengagement completion time based on the induced voltage Vk detected by the induced voltage detection portion, the engagement completion time being a time at which engagement of the clutch is actually completed, the disengagement completion time being a time at which disengagement of the clutch is actually completed; wherein the control portion determines a command timing based on any one of the engagement completion time and the disengagement completion time detected by the engagement/disengagement completion time detection portion, the command timing being a time at which a command is given to the clutch to perform an engaging operation or a disengaging operation.

2. The image forming apparatus according to claim 1, wherein:

the motor is a stepper motor, and the induced voltage detection portion detects, as the induced voltage Vk, a voltage of a phase coil of the stepper motor for a case where a current flowing through the phase coil is 0 (zero).

3. The image forming apparatus according to claim 2, wherein the engagement/disengagement completion time detection portion uses a first threshold Va to detect, as the engagement completion time, a time at which the induced voltage Vk becomes smaller than the first threshold Va, the first threshold Va being determined based on magnitude of an induced voltage for a case where a load placed on the motor is a minimum load with the clutch engaged.

4. The image forming apparatus according to claim 3, wherein the first threshold Va or the second threshold Vb is changed depending on a rotational speed of the motor.

5. The image forming apparatus according to claim 2, wherein the engagement/disengagement completion time detection portion uses a second threshold Vb to detect, as the disengagement completion time, a time at which the induced voltage Vk becomes greater than the second threshold Vb, the second threshold Vb being determined based on magnitude of an induced voltage for a case where a load placed on the motor is a maximum load with the clutch engaged.

6. The image forming apparatus according to claim 5, wherein the first threshold Va or the second threshold Vb is changed depending on a rotational speed of the motor.

7. The image forming apparatus according to claim 1, wherein the control portion determines the command timing in such a manner that a gap between two sheets of paper conveyed continuously by the roller has a value falling within a predetermined range.

8. The image forming apparatus according to claim 1, wherein the control portion determines a command timing at which a disengaging operation command timing is given to the clutch at stop of conveyance of the paper in accordance with the engagement completion time at start of conveyance of the paper in such a manner that a stop position of the paper conveyed by the roller falls within a predetermined range.

9. The image forming apparatus according to claim 1, wherein the roller includes a paper feed roller for sending, to a paper path, sheets of paper, one by one, loaded in a paper containing portion, and a timing roller for delivering, along the paper path, the paper sent by the paper feed roller to a transfer position at which an image is transferred onto the paper.

10. The image forming apparatus according to claim 9, wherein the clutch includes a paper feed clutch and a timing clutch, the paper feed roller is structured to be engaged with the motor through the paper feed clutch, and the timing roller is structured to be engaged with the motor through the timing clutch, and when the paper feed roller and the timing roller convey an n-th sheet of paper ("n" is an integer) and temporarily stop conveying the n-th sheet of paper, and then, the timing roller starts reconveying the n-th sheet of paper and the paper feed roller starts sending the (n+1)-th sheet of paper, the control portion determines a time to give an engagement operation command to the paper feed clutch in accordance with a stop position of the n-th sheet of paper determined based on a period of time from an engagement completion time of the paper feed clutch to a disengagement completion time of the timing clutch in such a manner that the (n+1)-th sheet of paper does not overlap the n-th sheet of paper.

11. The image forming apparatus according to claim 9, wherein the clutch includes a timing clutch, the paper feed roller is structured to be engaged with the motor without the clutch, and the timing roller is structured to be engaged with the motor through the timing clutch, and when the paper feed roller and the timing roller convey an n-th sheet of paper ("n" is an integer) and temporarily stop conveying the n-th sheet of paper, and then, the timing roller starts reconveying the n-th sheet of paper and the paper feed roller starts sending the (n+1)-th sheet of paper, the control portion determines a time to give a rotary drive command to the motor in accordance with a stop position of the n-th sheet of paper determined based on a period of time from a rotary drive start time of the motor to a disengagement completion time of the timing clutch in such a manner that the (n+1)-th sheet of paper does not overlap the n-th sheet of paper.

12. The image forming apparatus according to claim 9, wherein the clutch includes a paper feed clutch, the paper feed roller is structured to be engaged with the motor through the paper feed clutch, and the timing roller is structured to be engaged with the motor without the clutch, and when the paper feed roller and the timing roller convey an n-th sheet of paper ("n" is an integer) and temporarily stop conveying the n-th sheet of paper, and then, the timing roller starts reconveying the n-th sheet of paper and the paper feed roller starts sending the (n+1)-th sheet of paper, the control portion determines a time to give an engagement operation command to the paper feed clutch in accordance with a stop position of the n-th sheet of paper determined based on a period of time from the engagement completion time of the paper feed clutch to a rotary drive stop time of the motor in such a manner that the (n+1)-th sheet of paper does not overlap the n-th sheet of paper.

* * * * *